US006484371B1

(12) United States Patent
Romanko et al.

(10) Patent No.: US 6,484,371 B1
(45) Date of Patent: Nov. 26, 2002

(54) HIGH STRENGTH, FLEXIBLE, LIGHT WEIGHT HOOK AND LOOP BUNDLING STRAPS

(75) Inventors: Walter R. Romanko, Austin, TX (US); Hang N. Tran, Austin, TX (US); Ronald W. Ausen, St. Paul, MN (US); Curtis L. Larson, Hudson, WI (US); William C. Unruh, Inver Grove, MN (US); Michael W. Mills, Cottage Grove, MN (US); Kirit C. Mody, Shoreview, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/794,378

(22) Filed: Feb. 27, 2001

(51) Int. Cl.[7] ..... A44B 21/00
(52) U.S. Cl. ..... 24/306; 24/452
(58) Field of Search ..... 24/306, 442–452; 604/386–391, 393; 428/99, 100

(56) References Cited

U.S. PATENT DOCUMENTS

| | | | | | |
|---|---|---|---|---|---|
| 3,266,113 | A | | 8/1966 | Flanagan, Jr. | 24/204 |
| 3,328,081 | A | * | 6/1967 | Scruggs | 24/306 X |
| 3,557,413 | A | | 1/1971 | Engle | 24/201 |
| 4,001,366 | A | | 1/1977 | Brumlik | 264/147 |
| 4,056,593 | A | | 11/1977 | de Navas Albareda | 264/145 |
| 4,189,809 | A | | 2/1980 | Sotos | 24/204 |
| 4,215,687 | A | * | 8/1980 | Shaw | 606/60 |
| 4,775,310 | A | | 10/1988 | Fischer | 425/308 |
| 4,872,243 | A | | 10/1989 | Fischer | 24/442 |
| 4,894,060 | A | | 1/1990 | Nestegard | 604/391 |
| 4,931,344 | A | * | 6/1990 | Ogawa et al. | 428/100 |
| 4,963,410 | A | * | 10/1990 | Bryant | 428/100 |
| 4,999,888 | A | * | 3/1991 | Miller | 24/712.3 |
| 5,015,251 | A | * | 5/1991 | Cherubini | 606/203 |
| 5,048,158 | A | * | 9/1991 | Koerner | 24/16 R |
| 5,058,247 | A | | 10/1991 | Thomas et al. | 24/448 |
| 5,167,050 | A | * | 12/1992 | Korsen | 24/16 R |
| 5,174,483 | A | * | 12/1992 | Moore, IV et al. | 24/306 X |
| 5,200,245 | A | * | 4/1993 | Brodrick, Jr. | 428/100 |
| 5,260,015 | A | | 11/1993 | Kennedy et al. | 264/167 |
| 5,393,475 | A | * | 2/1995 | Murasaki et al. | 264/167 |
| 5,441,687 | A | * | 8/1995 | Murasaki et al. | 264/167 |
| 5,518,795 | A | | 5/1996 | Kennedy et al. | 428/100 |
| 5,620,769 | A | * | 4/1997 | Wessels et al. | 428/100 |
| 5,643,397 | A | | 7/1997 | Gorman et al. | 156/435 |
| 5,692,271 | A | | 12/1997 | Provost et al. | 24/452 |
| 5,732,445 | A | * | 3/1998 | Stodolka et al. | 24/16 R |
| 5,738,398 | A | * | 4/1998 | Miano | 24/442 X |
| 5,780,721 | A | * | 7/1998 | Levens | 73/40 |

(List continued on next page.)

FOREIGN PATENT DOCUMENTS

| | | | | |
|---|---|---|---|---|
| EP | 1066770 A1 | | 1/2001 | |
| GB | 2 241 987 A | * | 9/1991 | 24/442 X |

OTHER PUBLICATIONS

U.S. patent application Ser. No. 09/794,288, Romanko et al., filed Feb. 27, 2001.
U.S. patent application Ser. No. 09/794,823, Romanko et al., filed Feb. 27, 2001.
U.S. patent application Ser. No. 09/794,298, Romanko et al., filed Feb. 27, 2001.

*Primary Examiner*—Robert J. Sandy
*Assistant Examiner*—Ruth C. Rodriguez
(74) *Attorney, Agent, or Firm*—Darla P. Fonseca

(57) ABSTRACT

A mechanical fastener is provided which is lightweight, thin, flexible, and strong, and whose holding power is as great as, or greater than, the holding power of conventional hook and loop type fasteners.

37 Claims, 4 Drawing Sheets

U.S. PATENT DOCUMENTS 5,786,062 A * 7/1998 Callahan, Jr. et al. ..... 428/100
5,840,089 A * 11/1998 Chesley et al. ..... 51/295
5,861,201 A * 1/1999 Blackwelder et al. .... 428/36.91
5,882,774 A 3/1999 Jonza et al. ..... 428/212
5,902,427 A * 5/1999 Zinke et al. ..... 156/73.1
5,932,311 A * 8/1999 Kenney et al. ..... 428/100
5,933,927 A 8/1999 Miller et al. ..... 24/452
5,938,997 A * 8/1999 Sakakibara et al. ..... 264/167
5,945,193 A * 8/1999 Pollard et al. ..... 428/100
5,981,027 A * 11/1999 Parellada ..... 24/442 X
6,000,106 A 12/1999 Kampfer et al. ..... 24/452
6,035,498 A 3/2000 Buzzell et al. ..... 24/452
6,057,961 A 5/2000 Allen et al. ..... 359/494
6,060,146 A * 5/2000 Akeno et al. ..... 428/100
6,106,922 A 8/2000 Cejka et al. ..... 428/120
6,132,660 A 10/2000 Kampfer ..... 264/167
6,143,222 A * 11/2000 Takizawa et al. ..... 264/167
6,180,205 B1 * 1/2001 Tachauer et al. ..... 428/100
6,205,623 B1 * 3/2001 Shepard et al. ..... 24/30.5 R
6,301,755 B1 * 10/2001 Gaber ..... 24/450

* cited by examiner

HIGH STRENGTH, FLEXIBLE, LIGHT WEIGHT HOOK AND LOOP BUNDLING STRAPS

FIELD OF THE INVENTION

This invention relates generally to mechanical fasteners, and more particularly to mechanical fasteners having improved physical properties.

BACKGROUND OF THE INVENTION

Various types of mechanical fasteners are known to the art. Among these are the hook-and-loop type fasteners described in U.S. Pat. No. 4,775,310 (Fischer) and U.S. Pat. No. 4,872,243 (Fischer). Strip-like fasteners of this type, which comprise a large number of closely spaced hook-like projections that releasably engage loops of a companion fastener strip, are currently sold under brand names such as GET-A-GRIP®, Velcro®, and Aplix®.

While these early fasteners had some admirable properties, they also suffered from a number of infirmities. For example, early hook-and-loop type fasteners exhibited notch sensitivity, that is, a pronounced tendency to tear in one or more directions when the base film was notched or nicked by even slight tearing, or by sewing or otherwise securing the fastener to some other product. Typically, the tear would propagate between the rows of hooks.

To reduce notch sensitivity, so-called rip-stops have been integrally molded with the base of some fasteners. Rip-stops are features, typically in the form of humps or bumps, that reduce notch sensitivity by providing localized thickening of the base of the fastener. Rip-stops typically extend between, and are integrally molded with, the hooks in adjacent rows as well as the base. However, while rip-stops may be advantageous in certain applications, they add to the flex modulus, weight and bulk of the overall construction, and also inherently require additional molding provisions and the use of additional materials.

Other methods of reducing notch sensitivity have also been investigated. Thus, U.S. Pat. No. 6,035,498 (Buzzell et al.) discloses the lateral orientation of fastener preforms having discrete fastener elements integral with a base web. The preforms are laterally stretched between 2 and 10 times the width of the original preforms. These products are said to have lateral rip resistance due to the molecular orientation of the film. Moreover, the stretching is said to be capable of reducing the thickness of the base web significantly, depending on the stretch ratio. Thus, the reference notes that, while conventional fasteners have been formed with web thicknesses (between the hooks) of greater than 0.005 inches (0.127 mm), and typically 0.008 inches (0.203 mm) or more, some of the fasteners disclosed in the reference have base film thicknesses of 0.001 to 0.002 inches (0.025 to 0.051 mm). The reference also advocates the use of thermoplastic resins having a flex modulus of at least 150,000 pounds per square inch (1.03 $GN/m^2$) in the constructions described therein, noting that the use of such resins provides higher fastener performance.

However, the approach suggested by Buzzell et al. also has its disadvantages. Because the fasteners disclosed in this reference are stretched laterally, they have significant notch sensitivity in this direction. This is so even if the base film is first oriented longitudinally, followed by lateral stretching. Notch sensitivity in the lateral direction is a substantial detriment in bundling applications, because the propagation of tears in the lateral direction are a common cause of fastener failure in such applications. This is especially true if the items being bundled have sharp edges.

Another problem with earlier hook-and-loop type fasteners was their tendency to cause skin irritation. This problem, which was particularly an issue when these early devices were employed in personal care products such as diapers, sanitary napkins and hospital gowns, was an artifact of the method used to manufacture them. In particular, the methodology commonly used to make hook-and-loop type fasteners often caused the bases of these fasteners to terminate in a stiff, sharp edge. Also, the hook components of these fasteners frequently had an abrasive feel when placed against the skin.

U.S. Pat. No. 5,692,271 (Provost et al.) represents one approach to providing hook and loop type fasteners with a reduced tendency to cause skin irritation. The fasteners disclosed therein have edge margins that are feathered to reduce their thickness and stiffness, which is said to result in a softer, less irritating fastener tape. The product is also provided with rip-stops that are integrally molded with the base and which are offset relative to the hook elements so as to reduce the widthwise stiffness of the product.

U.S. Pat. No. 4,894,060 (Nestegard) represents another approach at reducing the skin irritation associated with the use of mechanical fasteners. This reference discloses a disposable diaper with an improved hook fastener portion (best shown in FIG. 2) whose hooks terminate in a rounded edging. Such a hook, termed a low Profile Extruded Hook (PEH), was designed to have peel and shear values highest in the cross direction as opposed to the machine direction. The individual hooks are formed by notching a ridged preform and then stretching the web in the longitudinal direction.

Profile Extruded Hooks provide excellent holding power on diapers and are resistant to the wearer accidentally (or purposefully) peeling the holding tabs and thus removing the diaper. In addition, the strength of PEH in the lateral direction has been sufficient for diaper tab applications. The reference notes that, as a result of the geometry of these hooks, the hook portions do not have an abrasive feel when they come into contact with the skin. The reference also notes that the hook members are more easily and firmly engaged with many types of loop fastener portions than the hook members on known commercially available hook fastener portions, in large part because they are very small compared to them.

Various methods have also been developed for the production of hook and loop type fasteners, in addition to the methods disclosed in the above noted U.S. Pat. No. 4,775,310 (Fischer) and U.S. Pat. No. 4,872,243 (Fischer). Thus, for example, U.S. Pat. No. 5,260,015 (Kennedy et al.) and U.S. Pat. No. 5,518,795 (Kennedy et al.) describe a method for forming extruded hook fastener strips on a roll equipped with hook-forming cavities in its surface. The strips are formed by extruding a plastic material into the interface between the forming roll and a loop web carried by a backing roll. The loop web is thus firmly bonded to the hook backing on the surface opposite from the hooks.

In spite of the above noted efforts at improving mechanical fasteners and the methods for making them, however, currently existing fasteners still suffer from a number of infirmities. One such infirmity is the stiffness or flex modulus of the overall article and, in particular, of the backing material. Another infirmity is thickness. In particular, most conventional fasteners have relatively stiff (high flex modulus), thick backing materials. For example, as noted above, Buzzell et al. advocates the use in the backing materials of high modulus resins, which would be expected to assume even higher moduli subsequent to the film orientation procedures described therein. This is undesirable for a number of reasons.

First of all, it is difficult to wind a fastener with a high flex modulus backing into a tight radius, as would be required in the bundling of small items (e.g., groups of optical fibers). Even if the fastener is successfully wound into a small radius, the increased bulk usually inherent in higher modulus backings causes the fastener to contribute significantly to the overall diameter of the bundled goods. This is undesirable in many bundling applications such as the bundling of optical fibers, because the bundled item must often be stored in splice enclosures and in other areas where space is at a premium.

Moreover, a high flex modulus contributes to flagging, i.e., the tendency of the fastener to decouple from itself at the terminal end of the mating surfaces. Flagging is especially problematic in the formation of small bundles having small radii, because such applications require the backing to flex the most. In addition to being unsightly, flagging may also compromise the integrity of the mechanical bond achieved with the fastener, and presents a surface which can be snagged, possibly resulting in decoupling. Flagging also presents a cavity in which external contaminants can accumulate, thereby rendering the fastener unsanitary and contributing to a decrease in the integrity of the coupling after repeated uses.

High flex modulus fasteners also conform more poorly to surfaces that they are wrapped around. This makes them more prone to slippage, since less of the fastener surface is in contact with the substrate. Moreover, because the fastener conforms so poorly to the surfaces of the bundled goods, the stress applied to bundled goods by such fasteners will not be evenly distributed. In the case of delicate goods such as optical fibers, this may result in cracking or breaking of the individual fibers or in signal distortion.

Some attempts have been made in the art to produce fasteners using lower modulus materials. These attempts have been largely unsuccessful, however. U.S. Pat. No. 5,692,271 (Provost et al.), for example, which discloses hook type fastener constructions of the general type commonly used in diapers, notes that it is known to reduce the abrasiveness of hook type fasteners by reducing the stiffness or flex modulus of the polymer used to mold the tape used in such fasteners. However, the reference also notes that, in doing so, the hooks become ineffective because they, too, lose their stiffness and hence their ability to secure a garment in place.

Perhaps because of the tendency of hooks to lose some of their holding power with decreasing stiffness, hook and loop type fasteners (which are to be distinguished from hook type fasteners that are devoid of loops) which are currently on the market are relatively thick and stiff, and therefore unsuitable for some applications. Moreover, due to the bulk of these devices, they are more costly on a materials basis than competing products (e.g., twist ties), and hence compete successfully with these products only in high end applications, or where use of such products would damage the goods being tied. Their bulk and thickness also is undesirable for before and during use.

U.S. Pat. No. 6,106,922 (Cejka et al.) describes coextruded fastener constructions in which the fastener is made out of a first and second layer that are joined together while they are still in a molten state. The fastener constructions are of the general type commonly used in diapers, and have a plurality of hooks extending from one or both surfaces of the fasteners. FIG. 5 of that reference depicts an embodiment wherein a lower layer of material forms the base of the fastener and an upper layer forms the surface layer on the base and the entirety of the stem material. Example 11 of the reference describes a fastener having the configuration shown in FIG. 3 of the reference, in which the core portion is formed from an elastic material and the shell portion is formed from a more rigid material. Example 20 of the reference describes a fastener having a 127 micron base film with an ABA structure, in which the middle layer composed of component B is elastic and has a thickness of about 25 microns. While the fasteners described in this reference have many desirable properties, they are made from very soft, low tensile strength materials. Accordingly, they are not well suited for bundling applications and other such end uses where a substantial amount of force is placed on the longitudinal axis of the fastener.

There is thus a need in the art for a mechanical fastener, and in particular a hook and loop type fastener, which is lightweight, strong, thin, and flexible (e.g., has a low flex modulus or degree of stiffness), and whose holding power is as great as, or greater than, the holding power of conventional hook and loop type fasteners. There is also a need in the art for a mechanical fastener having reduced notch sensitivity, especially in the lateral direction. These and other needs are met by the present invention, as hereinafter described.

SUMMARY OF THE INVENTION

The present invention provides a new class of fasteners which have reduced notch sensitivity, especially in the lateral direction, and which are lightweight, strong, thin, and flexible (e.g., have a low normalized flex modulus or degree of stiffness), and whose holding power is comparable to or greater than the holding power of conventional hook and loop type fasteners.

In one aspect, the present invention relates to a mechanical fastener, such as a hook and loop type fastener, which is uniaxially oriented in the longitudinal direction. Unlike prior art fasteners which are unoriented, biaxially oriented, or oriented in a lateral direction, the uniaxially oriented fasteners of the present invention exhibit improved tensile strength and reduced flex modulus in the longitudinal direction (due to the thinning of the film attendant to orientation), and improved notch sensitivity in the lateral direction. Because of these properties, the fasteners of the present invention are uniquely suited to provide improved performance in applications such as bundling. In some embodiments of this aspect of the invention, the fasteners may incorporate a laminate of the base film or backing and one or more additional layers that are either unoriented or biaxially oriented before being incorporated into the backing, thereby providing a fastener with improved physical properties for a particular application in both the longitudinal and lateral directions.

In another aspect, the present invention relates to a mechanical fastener comprising a substrate and having a plurality of hooks disposed on a first surface of the substrate, wherein the fastener has a bundle break strength of $s_{bb}$ and a stiffness s, wherein the ratio $r_{sbb/s}=s_{bb}/s$, and wherein $r_{sbb}/s$ is greater than 477, preferably at least about 500, more preferably at least about 1000, and most preferably at least about 2300.

In yet another aspect, the present invention relates to a mechanical fastener comprising a substrate and having a plurality of hooks disposed on a first surface of the substrate, wherein said fastener has a ratio $r_{w/a}$ defined by the equation $r_{w/a}$=weight/area, wherein said fastener has a bundle break strength $s_{bb}$, and wherein the ratio $s_{bb}/r_{w/a}$ is greater than 0.057 $(km/s)^2$, preferably at least about 0.07 $(km/s)^2$, more preferably at least about 0.12 $(km/s)^2$, and most preferably at least about 0.15 $(km/s)^2$.

In yet another aspect, the present invention relates to a mechanical fastener comprising a substrate and having a plurality of hooks disposed on a first surface of the substrate, wherein said fastener has a bundle break strength $s_{bb}$ and a thickness t, and wherein the ratio defined by the equation $r_{sbb/t}=s_{bb}/t$ is at least 28 $MN/m^2$, more preferably at least about 35 $MN/M^2$, and most preferably at least about 46 $MN/mr^2$. In some embodiments, the fastener also has a thickness of less than 1.40 mm, more preferably less than about 1.0 mm, and most preferably less than about 0.90 mm.

In yet another aspect, the present invention relates to a mechanical fastener comprising a substrate and having a plurality of hooks disposed on a first surface of the substrate, wherein said fastener has a bundle break strength $s_{bb}$ and a flagging f, and wherein the ratio defined by the equation $r_{sbb,f}=s_{bb}/f$ is greater than 7.4 $MN/m^2$, preferably at least about 9 $MN/m^2$, more preferably at least about 14 $MN/m^2$, and most preferably at least about 20 $MN/m^2$.

In a further aspect, the present invention relates to a mechanical fastener comprising a substrate and having a plurality of hooks disposed on a first surface of the substrate, wherein said fastener has a tensile strength st and a stiffness s, wherein the ratio $r_{st/s}=s_t/s$, and wherein $r_{st/s}$ is greater than 392, preferably at least about 400, more preferably at least about 1000, and most preferably at least about 1800.

In another aspect, the present invention relates to a mechanical fastener comprising a substrate and having a plurality of hooks disposed on a first surface of the substrate, wherein said fastener has a ratio $r_{w/a}$ defined by the equation $r_{w/a}$=weight/area, wherein said fastener has a normalized tensile strength $s_t$, and wherein the ratio $s_t/r_{w/a}$ is greater than about 0.058 $(km/s)^2$, preferably greater than about 0.08 $(km/s^2$, more preferably greater than about 0.9 $(km/s)^2$, and most preferably greater than about 0.13 $(km/s)^2$.

In another aspect, the present invention relates to a mechanical fastener comprising a substrate and having a plurality of hooks disposed on a first surface of the substrate, wherein said fastener has a thickness t and a tensile strength $s_t$, and wherein the ratio $r_{st/t}=s_t/t$ is greater than 28 $MN/m^2$, preferably at least about 40 $MN/m^2$, more preferably at least about 50 $MN/m^2$, and most preferably at least about 70 $MN/m^2$, and t is less than about 1.20 mm, more preferably less than about 1.0 mm, and most preferably less than about 90 mm.

In still another aspect, the present invention relates to a mechanical fastener comprising a substrate and having a plurality of hooks disposed on a first surface of the substrate, wherein said fastener has a flagging f and a tensile strength $s_t$, and wherein the ratio $r_{st/f}=s_t/f$ is greater than 6.2 $MN/m^2$, preferably at least about 6.5 $MN/m^2$, more preferably at least about 20 MN/m, and most preferably at least about 50 $MN/m^2$, and t is less than about 1.20 mm, more preferably less than about 1.0 mm, and most preferably less than about 90 mm.

In another aspect, the present invention relates to a mechanical fastener comprising a substrate and having a plurality of hooks disposed on a first surface of the substrate, wherein said fastener has a tensile modulus of $m_t$ and a stiffness s, wherein the ratio $r_{mt/s}=m_t/s$ is at least about 11000, preferably at least about 14000, more preferably at least about 37000, and most preferably at least about 41000.

In yet another aspect, the present invention relates to a mechanical fastener comprising a substrate and having a plurality of hooks disposed on a first surface of the substrate, wherein said fastener has a ratio $r_{w/a}$ defined by the equation $r_{w/a}$=weight/area, wherein said fastener has a normalized tensile modulus $m_t$, and wherein the ratio $m_t/r_{w/a}$ is greater than 0.46 $(km/s)^2$, preferably at least about 0.6 $(km/s)^2$, more preferably at least about 1 $(km/s)^2$, and most preferably at least about 3 $(km/s)^2$.

In another aspect, the present invention relates to a mechanical fastener comprising a substrate and having a plurality of hooks disposed on a first surface of the substrate, wherein said fastener has a normalized tensile modulus $m_t$ and a thickness t, and wherein the ratio $r_{mt/t}=m_t/t$ is greater than 0.2 $GN/m^2$, preferably greater than about 0.40 $GN/m^2$, more preferably greater than about 0.7 $GN/m^2$, and most preferably greater than about 1.5 $GN/m^2$, and wherein t is less than 1.40 mm, more preferably less than about 1.0 mm, and most preferably less than about 0.90 mm.

In another aspect, the present invention relates to a mechanical fastener comprising a substrate and having a plurality of hooks disposed on a first surface of the substrate, wherein said fastener has a flagging f and a tensile strength $s_t$, and wherein the ratio $r_{st/f}=s_t/f$ is greater than 48 $MN/m^2$, preferably at least about 50 $MN/m^2$, more preferably at least about 100 $MN/m^2$, and most preferably at least about 1.5 $MN/m^2$.

In still another aspect, the present invention relates to an article comprising a fastener tape which is wound into a roll. The tape may be wound around a spool or other device for ease of production and to give the resulting article greater mechanical integrity. The tape comprises a polymeric substrate which is uniaxially oriented along the longitudinal axis of the tape, and has a plurality of hooks disposed on a surface thereof. The article may also be equipped with a blade for cutting off a portion of the tape, and may be fashioned in the form of a dispenser for the tape.

In another aspect, the present invention relates to a mechanical fastener comprising a substrate and having a plurality of hooks disposed on a first surface of the substrate, wherein said fastener has a low flex modulus $m_f$.

In yet another aspect, the present invention relates to a hook and loop type fastener, wherein said fastener has a thickness t, and wherein t is less than 1.40 mm, preferably less than about 1.20 mm, more preferably less than about 100 mm, and most preferably less than about 90 mm.

In still another aspect, the present invention relates to fastener devices having any combination or subcombination of the above noted aspects, and to methods for using the same.

DETAILED DESCRIPTION OF THE INVENTION

1. Overview

It is to be understood that the values specified throughout this application for $s_{bb}$, $s_t$, $m_r$, s, $r_{w/a}$, t, and f are the values obtained, or that would be obtained, for a sample tested in accordance with the procedures set forth in the examples.

In accordance with the present invention, a novel family of mechanical fasteners is provided. In the preferred embodiment, these fasteners, which most commonly take the form of hook-and-loop type bundling or strap fasteners, have a base layer that is uniaxially oriented in the longitudinal direction (i.e., the direction of extrusion), and exhibit high strength and improved notch sensitivity. The fasteners of the present invention can be made as light weight constructions that exhibit low normalized flex moduli and low stiffness. Other characteristics that may be exhibited by various fastener constructions made in accordance with the present invention include a high bundle break strength to stiffness ratio, a high tensile load at break to stiffness ratio, a high tensile modulus to stiffness ratio, a high bundle break strength to weight ratio, a high tensile load at break to weight ratio, a high tensile modulus to weight ratio, and/or a high strength or tensile modulus to low total thickness ratio.

While the mechanical fasteners of the present invention may take a variety of forms, in one common form they are manufactured as hook-and-loop type bundling tapes comprising a hook portion, a backing or base layer, and loop material. The hook portion is preferably integral with the backing or base layer, although the present invention contemplates embodiments in which the two are distinct. Likewise, the loop material will most commonly be joined to the base layer through the use of an adhesive. In the preferred embodiment, the mechanical fasteners of the present invention will be formed such that the hook portion is disposed on a first side of the base layer, and the loop portion is disposed on a second side of the base layer.

2. Physical Description of Hook Portion

Figure 1:
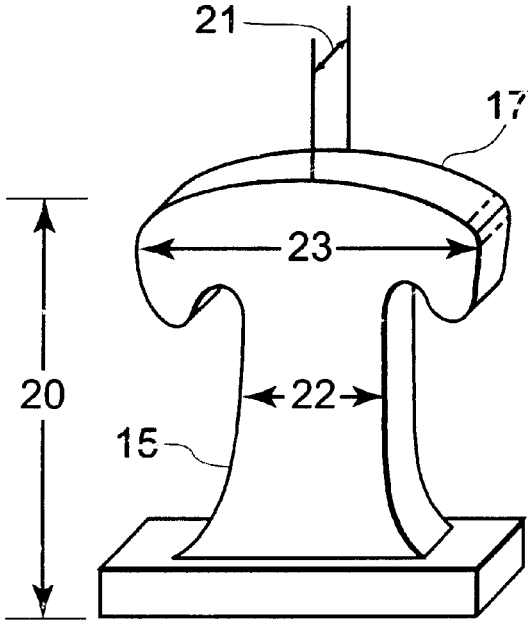
FIG. 1 is an enlarged perspective view of a type of hook useful in the mechanical fasteners of the present invention.
Figure 2:
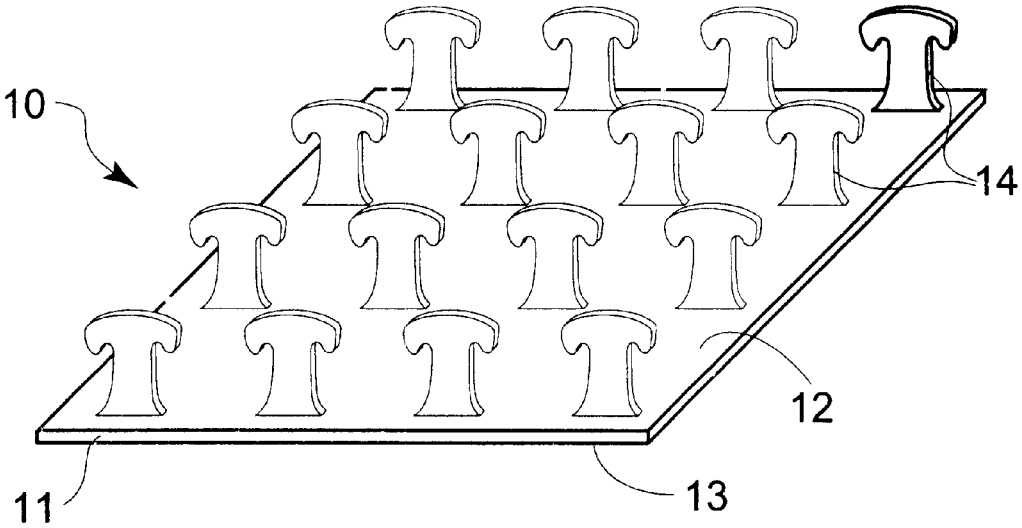
FIG. 2 is an enlarged perspective view of the hooks of FIG. 1.

FIGS. 1 and 2 show a preferred hook fastener portion for use in the mechanical fasteners of the present invention. This hook fastener portion is similar in design to the hook fastener portion set forth in U.S. Pat. No. 4,894,060 (Nestegard), but has a substantially lower profile. The hook fastener portion 10 comprises a thin, strong, flexible, film backing 11 which has generally planar and parallel upper and lower major surfaces 12 and 13. A multiplicity of resilient spaced hook members 14 project at generally right angles from the upper surface of the backing.

As is best seen in FIG. 1, the hook members each comprise a stem portion 15 attached at one end to the backing. A head portion 17 is positioned at the end of the stem portion opposite the backing. The sides of the head portion are flush with the sides of the stem portion on two opposite sides. The head portion has parts projecting past the stem portion on two opposite sides adjacent the radiused intersections of the stem portions with the backing.

Specifically, with reference to FIG. 1 which shows schematically a single hook member on which its dimensions are represented by reference numerals between dimensional arrows, the hook members each have a height dimension 20 as measured from the upper surface of the backing to the top of the hook of 0.010 to 0.030 inches (0.25 mm to 0.75 mm) and preferably in the range of about 500 um or 20 mils. The stem and head portions each have generally the same thickness dimension 21 (0.008 to.014 inches, or 0.02 to 0.036 cm, preferably about 0.011 to 0.013 inches or 0.028 to 0.033 cm) in a first direction parallel to the surfaces of the backing. The stem portions each have a width dimension 22 in the range of 0.02 to 0.03 centimeters (0.008 to 0.012 inches) in a second direction generally at a right angle to the first direction and parallel to the surfaces of the backing, and the head portions each have a width dimension 23 in the second direction that about 0.020 inches (0.51 mm).

3. Hook Portion Manufacturing Procedure

Various methods can be used to make hook portions suitable for use in the present invention. However, the preferred method is an adaptation of the known method of making hook fastener portions which is described in U.S. Pat. Nos. 3,266,113; 3,557,413 (Engle); 4,001,366 (Brumlik); 4,056,593 (de Navas Albareda); and 4,189,809 (Sotos). This method generally includes extruding a thermoplastic resin through a die shaped to form a base layer equipped with spaced ridges with flanges or arms that project above an upper surface of the base layer. These ridges have the cross-sectional shape of the hook portions to be formed. The ridges are then transversely cut at spaced locations along their length to form discrete portions of the ridges, and the backing layer is stretched to separate those portions of the ridges which are then the spaced hook portions.

Figure 6:
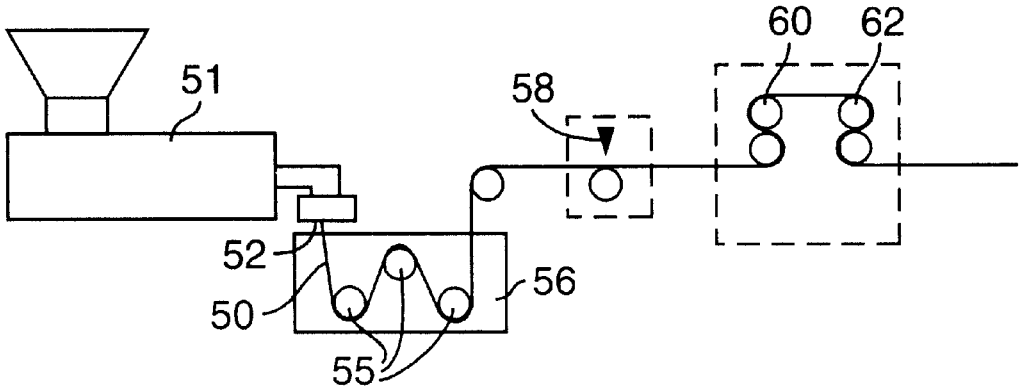
FIG. 6 is a schematic illustration of a method used to make the hook fastener portion of FIG. 1.
Figure 7:
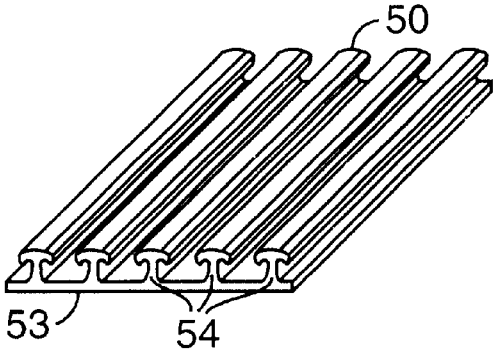
FIGS. 7 and 8 are perspective views of the hook fastener portion of FIG. 1 at various stages of its manufacture.
Figure 8:
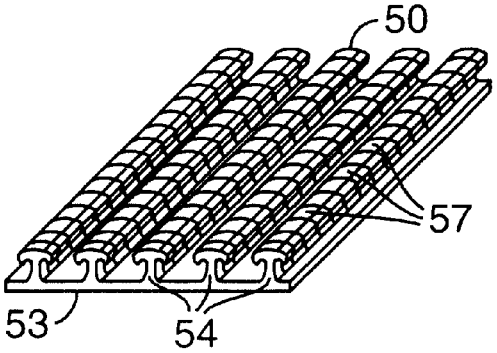

The method for forming the hook fastener portion in this way is schematically illustrated in FIG. 6. Generally, that method includes first extruding a strip 50 shown in FIG. 7 of thermoplastic resin from an extruder 51 through a die 52 having an opening cut by electron discharge machining. The opening is shaped to form the strip with a base 53 and elongate spaced ribs 54 projecting above an upper surface of the base layer. The ribs have the cross-sectional shape of the hook portions to be formed. The strip is pulled around rollers 55 and through a quench tank 56 filled with a cooling liquid (e.g., water). Next, the ribs (but not the base layer) are transversely slit or cut at spaced locations along their lengths by a cutter 58 so as to form discrete portions 57 having lengths corresponding to the desired lengths of the hook portions to be formed, as is shown in FIG. 8. The cutter can cut using any conventional means, and may be set to cut at an angle so as to allow the hooks to be oriented at an angle on the web.

After the ribs are cut, the base of the strip is longitudinally stretched at a stretch ratio of at least 2:1, more preferably at a stretch ratio of 3:1, and most preferably at a stretch ratio of at least about 4:1. The base is stretched between a hot roller 60 and a cold roller 62. The first roller has a diameter of about 15 inches, and is heated uniformly with oil heat or electrically to approximately 300° F. (149° C.). Uniform heating of the web is important for uniform stretching. The second roller is cooled with chilled water at approx 50° F. (10° C.). The web is stretched between the first and second roller. The web may be supported in the stretch area with an s-wrap idler roll to minimize necking at the stretch area. Heated rollers are commercially available from the Tokuden Corporation in Kyoto, Japan or from FR Gross Industries in the USA. Alternately, the web may be heated with IR beater or the like so long as the web base is heated to a uniform temperature in the range of about 290–310° F. (143° C. to 154° C.)

In making the hook fastener portion described above, the ribs are preferably spaced apart between their adjacent edges by about 0.50 millimeters, or between about 0.250 to 1.0 millimeters, and the stretching of the strip is sufficient to cause separation of the hook adjacent edge portions by at about 1.0 millimeters, or between about 0.5 to about 1.5 millimeters. Preferential heating of the base and not the hook aids in the uniformity of the hook spacing. Preferably, the hooks are spaced approximately 10/cm in the cross direction after stretching and about 8/cm in the downweb direction.

As noted above, the hook members each comprise a stem portion which is attached at one end to the base or backing. The hook members also comprise a head portion disposed at the end of the stem portion opposite the backing. The head portion projects past the stem portion on at least one of two opposite sides. Specifically, the hook members each have a height dimension from the upper surface of the backing to the top of the head of about 0.020 inches (0.5 mm). The stem and head portions each have generally the same thickness dimension which is preferably in the range of 0.025 to 0.033 centimeters (0.01 to 0.013 inches) in a first direction parallel to the surfaces of the backing. The stem portions each have a width dimension in the range of 0.018 to 0.03 centimeters (0.008 to 0.012 inches) in a second direction generally at a right angle to the first direction and parallel to the surfaces of the backing, and the head portions each have a width dimension in the second direction that is approximately 0.020 inches (0.5 mm). Hook members of this small size have been found to easily penetrate between and engage the loops on the inexpensive types of loop fastener portions described above.

The base or backing of the hook fastener portion is preferably thin enough to afford desirable flexibility (e.g., low normalized flex moduli or stiffness), but is also preferably either thick enough and/or strong enough to allow it to be attached to a substrate by any desired means such as sonic welding, heat bonding, sewing, or through the use of adhesives (including pressure sensitive, curable, or hot melt adhesives). The backing must also be thick enough and/or strong enough to firmly anchor the stems and provide resistance to tearing when the fastener is peeled open, but when it is used on a garment, should not be so thick that it is stiffer than necessary. The optimum thickness will vary depending upon the resin from which the hook fastener portion is made, but for polyolefin resins will generally be between about 0.002 to 0.005 inches (0.05 to 0.13 mm), more preferably between about 0.003 to 0.004 inches (0.076 to 0.10 mm). While the present invention contemplates the use of both film and woven backings, it is to be noted that film backings may offer an advantage over woven backings in certain applications in that film backings typically require the use of less adhesive to adhere them to a substrate than woven backings.

4. Types of Mechanical Fasteners

The principles of the present invention may be applied to produce a wide variety of mechanical fasteners. While the fasteners of the present invention will most commonly be hook and loop type fasteners in which the hook portion is disposed on a first side of a substrate and a loop portion is disposed on a second side of the substrate, the present invention also contemplates other types of fasteners to which the principles disclosed herein may be applied. These include, for example, hook to hook type fasteners, and fasteners in which a plurality of hooks and a plurality of loops are disposed on first and second surfaces, respectively. The principles of the present invention may also be applied to fasteners of the type that feature interlocking ridges and valleys, and which are used in articles such as resealable plastic bags.

The present invention also contemplates the application of the principles described herein to fasteners comprising at least a first and second strip which are coupled together to form a loop. In such embodiments, the two strips may be the same, similar, or different. Thus, for example, the strips may each have a first and second surface, the first surface being equipped with a plurality of hooks and the second surface being equipped with a plurality of loops. In other embodiments, the mechanical fastener may be a hook-to-hook type fastener in which both coupling surfaces of the fastener are provided with identical or similar hook structures that are capable of releasably intermating with each other.

5. Hook Types

The hooks employed in the various embodiments of the present invention may take a variety of forms, including those noted above. Thus, for example, the hooks may be of a filament type which are formed by cutting monofilament loops along one side so as to form a plurality of monofilament structures that protrude from a woven or knitted backing. The hooks may also be mushroom shaped, J-shaped or may take the form of a plurality of ridges. The hooks may also be molded or capped. Preferably, however, the hooks are PEH hooks as described herein. The hooks can be of the type described in U.S. Pat. No. 6,000,106 (Kampfer et. al.), hereinafter referred to as CS-600 hooks. The hooks can be of the type described in U.S. Pat. No. 5,058,247 (Thomas et. al.), or of the type described in U.S. Pat. No. 6,106,922 (Cjeka et. al.) or of the type described in U.S. Pat. No. 6,132,660 (Kampfer).

6. Loop Types

A variety of loop structures may be used in accordance with the present invention, and these structures may be formed in a variety of ways, the basic requirement being that the loop portion be capable of releasably coupling with the hook portion. Thus, for example, the loops may be formed by stitching, knitting, corrugating, or weaving thread or fiber into the appropriate loop structures. In particular, the loops may be formed by stitching thread through a backing, by sonically or thermally welding portions of fibers to a surface of the backing, by providing a nonwoven fibrous layer equipped with a plurality of loops, or by combinations of these methods.

7. Hook/Loop Patterns

The matable surfaces employed in the fasteners of the present invention will commonly employ a plurality of hooks and/or loops on each surface to be mated. These hooks and loops may be disposed in a variety of patterns as is dictated by the desired properties. For example, the hooks and/or loops may be randomly or semi-randomly disposed on each matable surface, or may be disposed in a particular pattern.

8. Other Surface Features

In addition to hooks and/or loops, the surfaces of the fasteners of the present invention may be equipped with other features to improve their physical characteristics or facilitate their use. For example, the matable surfaces may be equipped with one or more rip-stops to prevent tears from propagating across them. The surfaces may also be equipped with ridges to add strength or intentionally decrease the flexibility of the fastener along a desired axis, or with one or more troughs designed to cause the fastener to flex or fold in a particular direction. The surfaces may also be provided with holes in the construction to facilitate cinching in bundling applications.

Another surface feature that may be employed advantageously in the various embodiments of the present invention is depicted in FIGS. 4*a*–4*d*. The fastener 61 depicted therein has a plurality of hooks disposed on the upper surface 63 of the fastener, and a plurality of loops disposed on the lower surface 65 of the fastener. The upper surface of the fastener is further equipped with one or more hook-free zones 67. In the particular embodiment depicted, the lower surface of the fastener is also provided with one or more loop-free zones 69, although it is to be understood that the provision of hook-free zones and loop-free zones may be made independently of each other.

The hook-free and loop-free zones may be formed, for example, by selectively crushing or thermoforming the fastener at periodic or random intervals along its length, or in the vicinity of a terminal portion of the fastener, in such a way as to render the hooks in the zone non-functional. Suitable methods for modifying the hook portion of a fastener in this fashion are described, for example, in U.S. Pat. No. 5,933,927 (Miller et al.).

The hook-free zones may be employed as finger grips to facilitate the disengagement of the fastener. They may also be employed as a surface for displaying indicia, such as labels or color codes. The latter application is especially useful in the electrical or electronics industry, where this feature can be used, for example, to color code a bundle of wires having a common functionality. In some embodiments, the hook-free zones may be crimped or otherwise treated so that the zone will extend at an angle (e.g., 90°) from the plane of the fastener, thereby allowing the zone to serve as a built-in tab for easy identification purposes.

9. End Uses

The mechanical fasteners of the present invention may be used advantageously in various applications, including bundling, strapping, packaging, fastening, joining, attaching, holding, wrapping, and binding applications. The fasteners may be used in these and other applications for fastening cables, wires, cords, hoses, conduits, plant and tree limbs, grocery products, apparel, newspapers, magazines, drapery protective covers, and other items. The fasteners may be used to fasten or hold dissimilar items together, such as catheters to patients, or labels to trees, and may be employed in applications in various industries, including the electrical, electronic, telecommunications, optical, office, food, medical, appliance, aircraft, automotive, computer, agriculture, nursery and construction industries.

The mechanical fasteners of the present invention are particularly well suited for use in garments and in personal care products, such as disposable diapers, sanitary napkins, or hospital gowns. In these uses, the cost of the fastener is especially critical.

Since the fasteners of the present invention use less material than conventional fasteners and can be produced by simple manufacturing processes using inexpensive compositions, they provide the same or better mechanical performance than conventional fasteners at a lower cost.

Mechanical fasteners may also be produced in accordance with the present invention which are particularly well suited for bundling pressure sensitive items, such as optical fibers. The use of conventional fasteners in these applications has frequently proved undesirable, because such fasteners often concentrate bundle pressure over only a few points of contact, thus damaging the goods. This is the case both with conventional hook and loop type fasteners, as well as fasteners such as cable ties. In the case of optical fibers, for example, this may lead to breakage or signal distortion in one or more of the fibers. The fasteners of the present invention solve this problem by distributing the pressure evenly over the entire surface of the fastener, so that there are no localized pressure points. This is so because the increased flexibility of the fasteners of the present invention allow them to conform better to the surfaces of the materials being bundled, in much the same way that a thin plastic film of the type used to wrap food conforms to a surface better than thicker films of the same material which may be used, for example, to make construction materials. Consequently, when the fasteners of the present invention are used to bundle articles that do not form a collective mass of perfectly circular cross-section, the flexibility of the fastener distributes the bundling force evenly over the surface of the fastener, rather than concentrating it over a few points of contact as would a stiffer fastener. Moreover, compared to devices such as cable ties, the fasteners of the present invention provide a wider surface area over which the bundling force is distributed, in addition to the improved flexibility they provide. Consequently, the bundling force at any given point of contact is reduced.

The fasteners of the present invention may also be used advantageously as closures for bags or other containers; as bundling straps for bulk items such as carpet, linen, linoleum, fabric, and wrapping paper; for bundling pipes, sticks, lumber, and other longitudinal objects; as fasteners for commodity items such as paper and rolled goods; and for various other items, including printed circuit boards and electronic flex circuits.

The fasteners of the present invention may also be used for purposes other than, or in addition to, fastening or bundling. Thus, for example, the fasteners of the present invention may be used for labeling or identification. In these applications, the fasteners may be provided with color coding, printing, and other indicia useful for these purposes.

10. Materials Selection

Various materials may be used for the components of the fasteners of the present invention, including the hooks, loops, backings, adhesives, laminates, and release liners that may be employed therein.

A non-exhaustive list of suitable materials that can be used in the fabrication of the hook and loop portions of the fasteners, as well as possible intermediate laminate layers, includes thermoplastic resins such as polyolefins, including but not limited to polypropylene, polyethylene, and blends thereof; polyvinyl chloride; polystyrene; ABS; polyesters, including but not limited to polyethylene terephthalate; and nylons. Various blends and copolymers of the aforementioned materials may also be used. Representative examples of this later category include, for example, copolymers of polyethylene and polypropylene, blends of polypropylene with ethylene-vinyl acetate block copolymers, and styrene-ethylene-butylene-styrene block copolymers. Copolymers and homopolymers of PET that may be advantageously employed in the components of the present invention include PETG, PCTA, PCT and PCTG.

The resins used for PEH hooks preferably have a high melt viscosity, which allows the extrudate to maintain shape of hook out of die. As an example, a melt flow rate of about 1.5 is found to be suitable for PP within the context of the present invention.

11. Hook/Loop Density

The hook portion of the fasteners of the present invention may have any number of hooks, depending in part on the application to which the fastener is directed and the desired holding power. In a typical PEH construction, for example, the hook fastener portion might include about 80 hook members per square cm (at least 45 and preferably 70 to 100 hook members per square cm) projecting from the upper surface of the backing to provide the desired holding power. Other types of fasteners might have pin densities of 465 pins per square centimeter or less.

12. Other Materials

In addition to their primary materials, some of which have been noted above, any of the various components of the present invention may also incorporate other materials or additives. These include pigments, dyes, antioxidants, anti-static agents, strengthening or reinforcing agents, flame retardants, UV absorbers or reflectors, cross-linking agents, anti-static agents, and materials added to improve the temperature resistance of the components and the resistance of the components to chemicals and to soiling or staining.

13. Laminates/Other Layers

As noted above, in the various embodiments of the invention, laminates may be employed to impart desirable properties to the final product. Such constructions may allow the laminate as a whole to possess properties not exhibited by any of the component layers taken alone. Such laminates may include, for example, additional polymeric layers that may be oriented in one or more directions, either before or after being incorporated into the fastener. For example, one or more thin layers of biaxially oriented film, such as that in box sealing tape, may be added to a fastener whose backing has previously been oriented in the longitudinal direction. Thus, for example, such a laminate fastener may exhibit, in addition to the useful properties imparted by the longitudinal orientation of the base film, improved tear resistance along its longitudinal axis as a result of the biaxially oriented layer. Laterally oriented layers may be used for similar purposes.

In one particular embodiment, a fastener is made in accordance with the present invention which comprises a laminate of an unoriented hook backing and a layer of #355 box sealing tape. In this embodiment, the box sealing tape, which is a high tensile strength, high modulus material, improves the tensile strength of the overall construction, while the unoriented hook backing (CS600) improves the notched tear resistance of the overall construction.

Some embodiments of the present invention may also incorporate one or more layers of biaxially oriented polypropylene (BOPP) and/or simultaneous biaxially oriented polypropylene (SBOPP). These materials are particularly useful in that they impart to the laminate high strength, light weight, and high tensile modulus, and contribute favorably to the various ratios used herein to characterize performance.

One or more layers of adhesive (either curable, pressure sensitive or hot melt) may also be utilized in the various constructions of the invention. The choice of adhesive for a particular embodiment will be dictated in part by the materials of the surfaces being bonded together. However, adhesives useful in the present invention include acrylic based pressure sensitive adhesives and other adhesives as are well known to the art. Natural and synthetic rubber-based pressure sensitive adhesives and crosslinkable polyurethanes are also useful.

In addition to the various polymeric materials already noted, the additional layers in such laminate structures may also comprise fibrous materials, such as glass, carbon, or polymeric fibers. These fibers may either be present by themselves (e.g., as a woven or intermingled mass), or may be embedded in a polymeric matrix. Such fiber constructions can enhance the tear and split resistance of the fastener in one or more directions, and increase the tensile modulus and tensile strength.

Figure 3A:
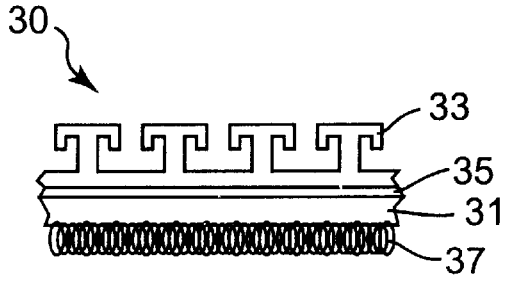
FIGS. 3*a–g* are schematic diagrams showing different mechanical fasteners made in accordance with the present invention.

Some specific hook and loop laminate structures that may be made in accordance with the present invention are depicted in FIGS. 3*a*–3*g*. With reference to FIG. 3*a*, the fastener 30 shown therein comprises a film layer 31 having first and second surfaces. A hook layer 33 is adhered to a first surface of the film layer by means of an adhesive layer 35, and a loop layer 37 is disposed on a second surface of the film layer. In the particular embodiment depicted in FIG. 3*a*, the loops in the loop layer are attached directly to the film layer, which may be accomplished, for example, by contacting the loop material with the second surface of the film material while that surface is in an impressionable state. However, the loop material may also be attached to the film layer by means of an adhesive layer.

Figure 3D:
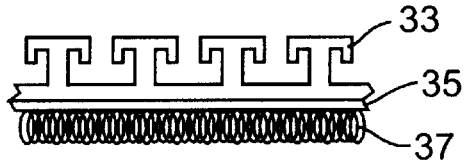
Figure 3B:
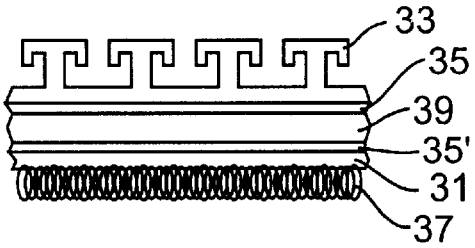

FIG. 3*b* depicts a second embodiment of a hook and loop laminate structure. In this embodiment, a reinforcing layer 39 has been inserted between the film layer and the hook layer, and a second adhesive layer 35' has been provided to secure the film layer to the reinforcing layer. The reinforcing layer may be processed independently of the other layers in the laminate, and is selected to impart desired properties to the overall laminate. Thus, for example, the reinforcing layer may be oriented in one or more directions to impart improved tear resistance to the laminate along a certain axis. The reinforcing layer may also contain reinforcing elements of the type noted with respect to FIG. 3*c*.

Figure 3E:
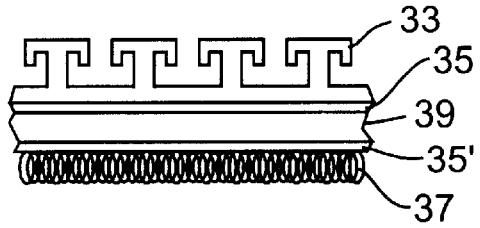
Figure 3C:
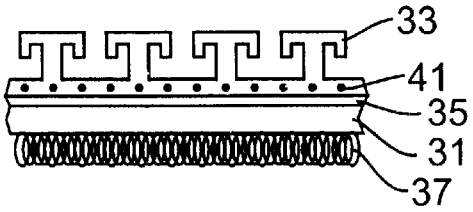

FIG. 3*c* depicts an embodiment similar to that of FIG. 3*a*, but having reinforcement elements 41 disposed in the hook layer 33. These reinforcement elements may be, for example, glass, carbon or polymeric fibers such as the aromatic polyamide fibers sold under the brand name Kevlar™.

FIG. 3*d* depicts an embodiment similar to that of FIG. 3*a*, except that the laminate contains no film layer and the loop layer 37 is adhered directly to the hook layer 33 by means of the adhesive layer 35. Fasteners of this type may be advantageous in applications where the thinness and flexibility of the fastener is especially critical. With proper choice of materials and appropriate processing of the hook layer, many of the benefits of having a separate film layer in the laminate can still be achieved with fasteners of this configuration.

FIG. 3*e* depicts an embodiment similar to that of FIG. 3*b*, except that the laminate contains no film layer and the loop layer 37 is adhered directly to the reinforcing layer 39 by means of the second adhesive layer 35'.

Figure 3F:
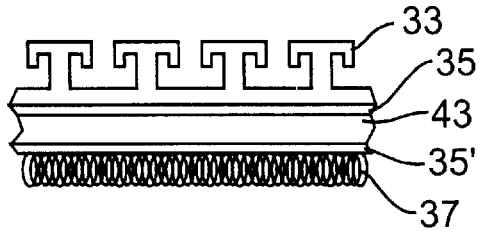

FIG. 3*f* depicts an embodiment similar to that of FIG. 3*e*, except that the reinforcing layer has been replaced by a graphics layer 43. This embodiment takes advantage of the relatively high transparency or transmission values that can be achieved with the fasteners of the present invention, which allows the fasteners to be used to display graphics in addition to their normal function as fasteners. The graphics layer, which may otherwise be similar to the film or reinforcing layers previously noted, may contain visual indicia such as graphics or text, or color coding. In some embodiments, the graphics layer may be made from optical films having mirroring, polarizing, or color shifting properties. Such films, which may be multilayer films or continuous/disperse phase films, are described, for example, in U.S. Pat. No. 5,882,774 (Jonza et al.) and U.S. Pat. No. 6,057,961 (Allen et al.), both of which are incorporated herein by reference in their entirety. The graphics layers may also contain fluorescent dyes or pigments which may be used, for example, for security or verification purposes.

Figure 3G:
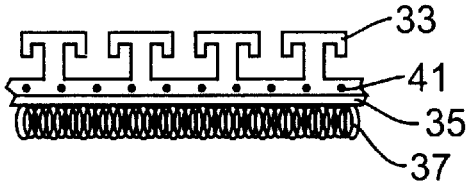
Figure 4A:
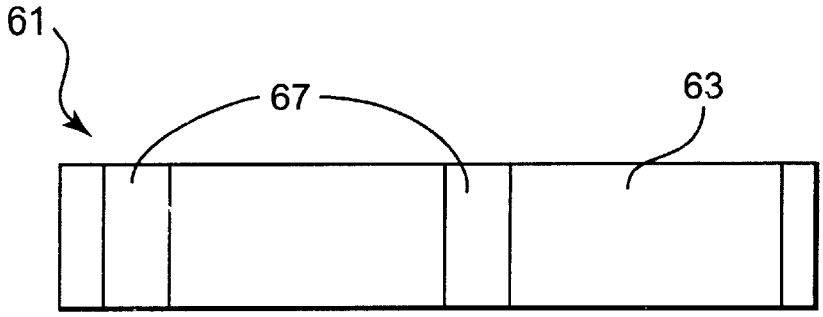
FIGS. 4*a–d* are schematic illustrations of hook and loop type fasteners which are provided with crushed or hook-free zones.
Figure 4B:
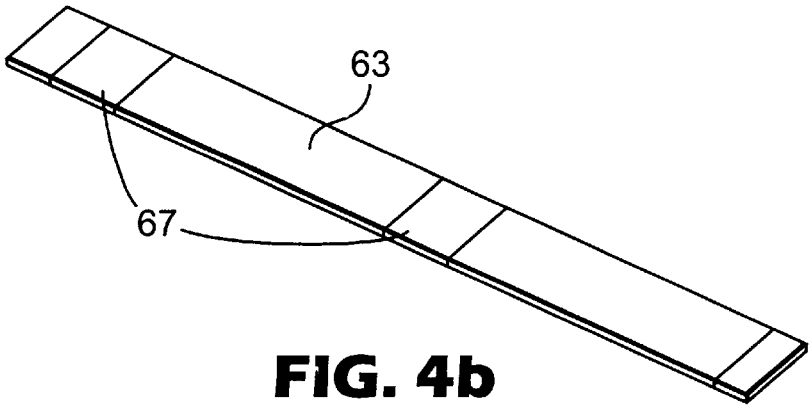
Figure 4C:
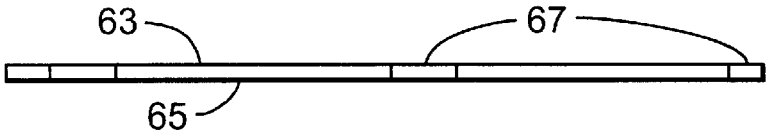
Figure 4D:
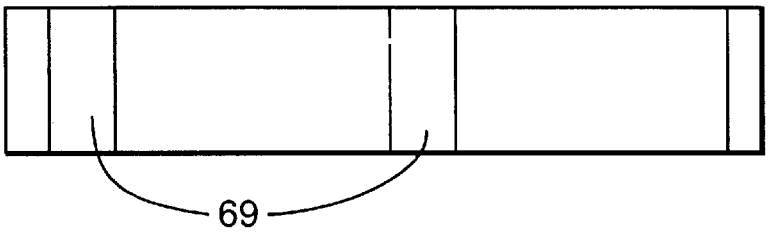

FIG. 3*g* depicts an embodiment similar to that of FIG. 3*c*, except that the film layer has been removed. Constructions of this type can be made which have the advantages of the construction depicted in FIG. 3*d*, with the additional benefits of reinforcement elements 41.

14. Samples Tested

As referred to in the samples, Acrylate PSAA-1 is a 0.030 mm thick acrylate pressure sensitive adhesive comprising 87.4% isooctyl acrylate, 2.59% acrylic acid, 9.66% n,n-dimethylacrylamide, 0.15% Irgacure 651 (Ciba Specialty Chemicals, Tarrytown, N.Y.), 0.055% isooctyl thioglycolate, and 0.20% acryloxy benzophenone.

The following samples are referred to in the examples and comparative examples.

CS600-864: SCOTCH #864 ribbed PP strapping tape with synthetic rubber PSA (3M Co., St. Paul, Minn.) was adhered to the non-loop side of XML-7099 extrusion bonded loop backing, a loop material available from 3M, St. Paul, Minn. and made in accordance with the methodology described in U.S. Pat. No. 5,643,397 (Gorman et al.). This loop material is made from 48 g/m$^2$ nonwoven PP fiber and has a 0.031 mm PP backing. XMH-99-023, a product available from 3M which consists of a hook backing, with a pin density of 320/cm$^2$ and a synthetic rubber Pressure Sensitive Adhesive (PSA) on the smooth side, was bonded to the #864 tape side of the laminate, resulting in a high strength, light weight, thin, flexible hook-reinforcing layer-loop construction.

CS600-355: This sample was made in a manner similar to that of CS600-864 except that, instead of SCOTCH #864 tape, two layers of SCOTCH #355 box sealing tape (biaxially oriented PET backing with natural rubber PSA and available from 3M) were used. Before additional laminates were placed on top of the #355 tape, the low adhesion backside release surface of the #355 tape was lightly scraped off with a razor blade to ensure better adhesion of the adhesive to the tape backing. This resulted in a high strength, light weight, thin, flexible hook-reinforcing layer-loop construction.

CS600-898: This sample was made in a manner similar to CS600-355, but instead of two layers of #355 tape, one layer of SCOTCH #898 filament tape (SCOTCHPAR film with glass yarns embedded in the natural rubber based PSA, available from 3M) was used. This resulted in a high strength, light weight, thin, flexible hook-reinforcing layer-loop construction.

CS600-880: This sample was made in a manner similar to CS600-355, but instead of two layers of #355 tape, one layer of SCOTCH #880 filament tape (SCOTCHPAR film with polyester yarns embedded in the natural rubber based PSA, available from 3M) was used. This resulted in a high strength, light weight, thin, flexible hook-reinforcing layer-loop construction.

CS600-8970: This sample was made in a manner similar to CS600-355, but instead of two layers of #355 tape, one layer of SCOTCH #8970 glass cloth tape (glass cloth, 3M) was used, and Acylate PSA A-1 was used to bond the #8970 tape to the extrusion bonded loop backing. This resulted in a high strength, light weight, thin, flexible hook-reinforcing layer-loop construction.

PEH 3:1: The hooks and strengthened backing for this sample were made by extruding a polypropylene copolymer with an mfi of approximately 1.5 through a 2½ inch extruder into a die with an outlet orifice. The outlet orifice was cut by electron discharge machining to generate a rib with the desired cross sectional shape described and shown in FIG. 1. The rib width was 500 microns. The web was quenched in a water bath immediately at the die outlet at approximately 10° C. The web was then dried by passing compressed air over the web to remove water from the ribs and base. The ribs were then cut with a multiplicity of blades.

After the ribs were cut, the web was subsequently oriented in the longitudinal direction by passing it over a 146° C., 15 inch diameter, chrome plated, oil heated roll at approximately 225 degrees of wrap. Unconstrained drawing was performed between this roll and another 15 inch diameter, chrome plated, 10° C. roll, at a draw ratio of 3:1. The wrap around this roll was also approximately 225 degrees, with the smooth side against the roll. Annealing of the roll occurred with reheating to 146° C. followed by immediate quenching to 10° C. in a station identical to that described previously, but at a draw ratio of 1:1. The weight/area of the hook web was 134 g/m$^2$. This hook and strengthened backing was bonded to XML-7099 extrusion bonded loop (available from 3M) backing via acrylate PSA A-1, resulting in a high strength, lightweight, flexible, thin, hook and loop strap.

PEH 5:1: This sample was made in a manner similar to PEH 3:1, except that, during hook production, the web was drawn to a draw ratio of 5:1 instead of 3:1, providing a hook web with a 117 g basis weight. This resulted in a high strength, light weight, thin, flexible hook and loop strap.

CS1200T/EBL: XMH-00-191, a Profile Extruded Hook (PEH) portion available from 3M Co. which is designed to be used in the cross direction and is provided with a synthetic rubber pressure sensitive adhesive (PSA), was laminated to an extrusion bonded loop portion XML-00065 (also available from 3M) with the PEH orientation direction arranged along the longitudinal axis of the strap. This resulted in a high strength, light weight, thin, flexible hook and loop type strap fastener.

CS1200T/45g: This sample was similar to CS1200T/EBL, but without the synthetic rubber PSA. The smooth side of this PEH was corona treated, and to this side was applied a moisture curable polyurethane adhesive at a rate of 4.1 g/m$^2$. A 45 gram/m$^2$ white nylon tricot knitted loop was applied to the adhesive, and the adhesive was allowed to cure. The PEH was incorporated into the strap assembly in such a way that its direction of orientation was aligned with the longitudinal axis of the strap. The resultant composition was a high strength, light weight, thin, flexible hook and loop type strap fastener.

CS1200T-450S: The hooks and strengthened backing for this sample were made in a manner similar to those of PEH 3:1, but with the following exceptions. The width of the hook arms (element 23 in FIG. 1), was 450 microns. The transverse cuts, made with a multiplicity of blades, were cut down to the base of the stem. The web was longitudinally oriented at a temperature of 110° C., and finally annealed at a temperature of 100° C. This hook and strengthened backing was bonded to XML-7099 extrusion bonded loop (available from 3M) backing via acrylate PSA A-1, resulting in a high strength, lightweight, flexible, thin, hook and loop strap.

CS1200T-450R: The construction of this material was similar to CS1200T-450S, except that during the hook and strengthened backing production, the multiplicity of blades did not cut the ribs down to the base of the film. Rather, the blades were raised 100 microns from the base of the film to result in a small ridge between hooks along the longitudinal direction. The resultant construction was a high strength, lightweight, flexible, thin, hook and loop strap.

CS1200T-525S: The construction of this sample is similar to that of CS1200T-450S, except that the hook width was 525 microns. The resultant construction was a high strength, lightweight, flexible, thin, hook and loop type strap fastener.

CS1200T-525R: The construction of this sample was similar to that of CS1200T-450R, except that the hook width was 525 microns. The resultant construction was a high strength, lightweight, flexible, thin, hook and loop type strap fastener.

CS600 NoDraw: XMH-00-194 hook material (available from 3M), was bonded to XML-7099 extrusion bonded loop (also available from 3M Co.) backing via acrylate PSA A-1, resulting in a lightweight, flexible, thin, hook and loop type strap fastener.

CS600 2.5:1: In the manufacture of this sample, the XMH-00-194 hook portion of CS600 NoDraw was first longitudinally oriented under the following conditions: the orientation station roll temperatures (as in Example 6) were set at 102° C. and 29° C., respectively, and the draw ratio was 2.5:1. The anneal rolls were set at 41° C. and 16° C., respectively.

The hook portion was bonded to XML-7099 extrusion bonded loop (available from 3M) backing via acrylate PSA A-1, resulting in a high strength, lightweight, flexible, thin, hook and loop type strap fastener.

CS600 3:1: This sample was made in a manner similar to CS600 2.5:1, except that the draw ratio was 3:1, the draw station temperatures were 93° C. and 29° C., and the anneal station temperatures were 57° C. and 16° C. The resultant construction was a high strength, lightweight, flexible, thin, hook and loop type strap fastener.

CS600 4:1: This sample was made in a manner similar to CS600 3:1, except that the draw ratio was 4:1, the draw station temperatures were 102° C. and 29° C., and the anneal station temperatures were 85° C. and 16° C. The resultant construction was a high strength, lightweight, flexible, thin, hook and loop type strap fastener.

ABS PEH: This sample was made in a manner similar to PEH 3:1, except that, instead of PP, MAGNUM 555 ABS (Dow Plastics, Midland, Mich.) was used, the extrudate was forced-air quenched, the draw and annealing temperature were 160° C., and the hook web basis weight was 257g/m$^2$. This resulted in a high strength, light weight, thin, flexible hook and loop type strap fastener.

HDPE PEH: This sample was made in a manner similar to PEH 3:1, except that HDPE DGDL-3364 (available from the Union Carbide Corporation, Danbury, Conn.) was substituted for the PP and this material was extruded at an extruder temperature of 232° C. The draw and annealing temperatures were 127° C., and the hook web basis weight was 198 g/m$^2$ This resulted in a high strength, light weight, thin, flexible hook and loop strap.

Nestegard: A hook web with a basis weight of 170 g/m$^2$ was made in accordance with the procedures set forth in U.S. Pat. No. 4,894,060 (Nestegard). This hook was then laminated to XML-7099 extrusion bonded loop (available from 3M Co.) backing via acrylate PSA A-1, resulting in a hook and loop type strap fastener.

CS600 Tape53: XMH-99-023 (available from 3M), a hook backing with a synthetic rubber Pressure Sensitive Adhesive (PSA) on the smooth side, was laminated to XML-00-010 extrusion bonded loop (available from 3M; the nonwoven fiber component was 53 gram/m$^2$) backing, resulting in a hook and loop type strap fastener.

CS600 Tape48: This sample was made in a manner similar to CS600Tape 53, except that XML-7099 extrusion bonded loop (available from 3M; the nonwoven fiber component was 48 gram/m$^2$), was used instead of XML-00-010, resulting in a hook and loop type strap fastener.

SCOTCHMATE: SCOTCHMATE SJ 3526 mechanical fastening hook tape with adhesive (available from 3M) was adhered to SCOTCHMATE SJ 3527 loop (available from 3M Co.), back to back, resulting in a hook and loop type strap fastener.

CS500: A TP43120 Plain Back Dual Lock hook material (available from 3M) was laminated to XML-7099 extrusion bonded loop (available from 3M) backing via acrylate PSA A-1, resulting in a hook and loop type strap fastener.

Velcro: Velcro™ GET-A-GRIP™ bundling strap (Velcro USA, Manchester, N.H.) was obtained commercially. The product packaging listed U.S. Pat. No. 5,518,795 (Kennedy et al.).

Belkin: Belkin Components (Compton, Calif.) P53228/F8B024 hook and loop cable tie was obtained commercially. One side of the 17.4 mm wide sample was covered with loops; the opposite side had hooks covering only the first 33 mm of length. Thus, two values of thickness and modulus were obtained for this sample. The value most indicative of the intent of the testing herein was used in calculations.

Aplix: Aplix™ hook and loop type strap fastener 221/220 was obtained commercially from Aplix USA, Charlotte, N.C.

Aplix †: Sample obtained commercially, believed to be of the Aplix 221/220 type.

The invention will now be described in reference to the following specific examples and comparative examples. The direction of hook backing orientation and/or the direction of reinforcement was parallel to the longitudinal axis of the resultant hook and loop straps. All samples were tested in the longitudinal direction.

EXAMPLES 1–20 and COMPARATIVE EXAMPLES C1–C7

These examples illustrate the improvements in bundle break strength, flex modulus, and the ratio of bundle break strength to flex modulus which are attainable with the fasteners of the present invention.

A variety of fasteners, including some conventional fasteners as well as some fasteners which were made in accordance with the present invention, were subjected to the wire bundling test described below, which is a modified version of the test described in the UL-1565 specification. The UL-1565 test for Wire Positioning Devices was developed for rating the strength of cable ties and related bundling devices. One aspect of UL-1565 consists of wrapping a bundle of 14 AWG wires with the desired fastener. Two wires on opposing sides of the wrapped bundle circumference are then pulled apart at a rate of 1 inch/min (25.4 mm/min) to test the integrity of the fastener. Once the desired rating force is obtained, the fastener tension is maintained at this constant force. To obtain a particular force rating, the bundle must be able to withstand the rating force for 1 minute without slippage (i.e., of the cable tie ratchet mechanism). As stated in UL-1565, the fastener must not slip more than 1/16" (1.59 mm) during this 1 minute test.

UL-1565 states that samples of different construction from the Standard may be "tested according to the intent of the requirements". This is of particular relevance here, because the test set forth in UL-1565 was developed for testing and rating nylon cable ties, and the application of this test to hook-and-loop type fasteners can be somewhat problematic. In particular, interpreting the stretching of a hook and loop strap to be the described cable tie ratchet slippage creates a challenge in determining how much stretch is allowable, because the amount of stretch that a fastener experiences is different for different bundle diameters, different fastener widths, and different force ratings.

Accordingly, a modified version of UL-1565 was used in the present experiments to eliminate any inconsistencies between fastener samples due to fastener stretch, relaxation, and other such variables. The modified version test pulls on the bundle at the same rate of 1 inch/min (25.4 mm/min), but continues at this rate until the fastener fails. Although this procedure neglects the slippage/stretching analogy, the materials of the present invention are seen to surpass commercial hook and loop products by possessing much higher moduli and lower stretch at break.

Unless otherwise noted, all bundle tests were conducted using a 14 AWG wire, a 25 mm (1 inch) diameter bundle, and a 12.7 mm x 152 mm (½"×6.0") fastener strap oriented such that the fastener loops faced into the bundle. Stiffness was measured and normalized to the fastener width in order that fastener thickness is not included (N/m rather than $N/m^2$), for reasons that follow.

Traditionally, tensile strength, Young's (tensile) modulus, and flex modulus values have been defined in terms of force per sample cross sectional area, providing a value indicative of a material's inherent properties. However, in a multi-component hook and loop strap construction, nothing is gained in describing these properties in terms of the product of thickness and width, since a major portion of the thickness component comprises dead space around loops and hooks. This dead space does not contribute to the properties of the structure. Hence, the technical properties of such a multi-component strap are best described when normalized to strap width only. In addition, the usefulness of a multi-structure strap to a consumer can be better described in terms of properties normalized to strap width. If the consumer requires higher strength, etc., for an application, then they would utilize a wider strap, multiple straps, or multiple wraps. Data are thus given here in terms of tensile strength, Young's (tensile) modulus, and stiffness normalized to strap width.

As noted previously, it has been found to be desirable to maximize the bundle break strength of the fastener while minimizing the stiffness, since excessive stiffness makes a sample difficult to work with and contributes to flagging. The ratio of bundle break strength to stiffness ($r_{sbb/s}=s_{bb}/s$) is informative in this regard, with a high value for $r_{sbb}/s$, being desirable. TABLE 1 displays the bundle break strength ($s_{bb}$), stiffness (s), and the ratio of the bundle strength to stiffness for a number of fastener samples. The stiffness of these samples was measured on a Rheometrics (Piscataway, N.J.) RSA II Solids Analyzer using the 3-point bending fixture at 25° C. The distance between the two outside "points" was 10.0 mm, with a width 12.7 mm for each of the three "points". The three points were positioned in a collinear manner, and samples, which had not been previously flexed or bent, were inserted such that their length direction spanned the three points. After inserting the sample, the highest force value displayed was recorded. Samples were inserted both hooks oriented up and hooks oriented down, with an appropriate number of values recorded and averaged.

TABLE 1

Bundle strength, stiffness, and the ratio of these two values for various fastener constructions.

| Example | Sample | Bundle Break Strength (N/m) | Stiffness (N/m) | Bundle Break Strength/ Stiffness |
|---|---|---|---|---|
| 1 | CS1200T/45g | 30,000 | 13 | 2,310 |
| 2 | CS1200T/EBL | 25,000 | 19 | 1,320 |
| 3 | PEH 5:1 | 22,300 | 17 | 1,300 |
| 4 | CS600-898 | 42,000 | 33 | 1,270 |
| 5 | CS600-8970‡ | 46,600 | 45 | 1,050 |
| 6 | CS600-355* | 31,700 | 32 | 988 |
| 7 | CS1200T450R | 33,700 | 34 | 980 |
| 8 | CS600 4:1 | 15,700 | 17 | 902 |
| 9 | CS600-880* | 42,700 | 50 | 849 |
| 10 | CS1200T525S | 29,200 | 36 | 813 |

TABLE 1-continued

Bundle strength, stiffness, and the ratio of these two values for various fastener constructions.

| Example | Sample | Bundle Break Strength (N/m) | Stiffness (N/m) | Bundle Break Strength/ Stiffness |
|---|---|---|---|---|
| 11 | CS1200T525R | 25,100 | 33 | 770 |
| 12 | CS600 2.5:1 | 15,600 | 21 | 754 |
| 13 | CS1200T450S | 23,800 | 34 | 708 |
| 14 | CS600 3:1 | 13,700 | 19 | 706 |
| 15 | PEH 3:1 | 18,600 | 29 | 650 |
| 16 | Nestegard | 21,000 | 41 | 508 |
| 17 | CS600-864 | 13,900 | 28 | 496 |
| C1 | CS600 Tape48 | 4,480 | 9 | 477 |
| 18 | HDPE PEH | 22,100 | 48 | 461 |
| C2 | Aplix*† | 38,500 | 92 | 420 |
| C3 | CS600 Tape53 | 5,040 | 19 | 270 |
| C4 | Velcro* | 22,300 | 118 | 189 |
| 19 | CS600 NoDraw | 9,700 | 72 | 135 |
| C5 | Belkin* | 19,300 | 198 | 97 |
| C7 | CS500 | 13,900 | 157 | 88 |
| 20 | ABS PEH | 8,760 | 109 | 80 |
| C7 | SCOTCHMATE | 23,700 | 325 | 73 |

Unless otherwise noted, all samples had backing tear failure;
*samples had hook-to-loop shear failure;
‡Sample tested had adhesive to reinforcing layer failure in bundle test.
†sample believed to be Aplix.
Belkin sample had hooks on only approximately 33 mm length of one side;
stiffness shown for this sample is section with hooks and loops.

As seen from the results in TABLE 1, the constructions of the present invention are as strong as, or stronger than, the conventional fasteners tested, but are much more flexible. The Velcro, CS500, and Scotchmate samples possess little or no orientation or reinforcement in the construction; consequently, the ratio $r_{sbb/s}$, is low for these samples. The Nestegard patent PEH sample gave a construction with a $r_{sbb/s}$ ratio higher than that of Velcro. With the exception of the CS600-864 sample, all of the constructions containing some strength enhancement have $r_{sbb/s}$ ratios higher than even the Nestegard sample. The CS600 Tape samples, with no reinforcement, have little strength. This test generally measures the ability of the construction to withstand a tear-through initiated by the pulling wire.

EXAMPLES 21–40 and COMPARATIVE EXAMPLES C8–C14

These examples illustrate the improvements in bundle break strength per unit of weight area that are achievable with the fasteners of the present invention.

As noted previously, it has been found to be desirable to minimize the weight of the fasteners while at the same time increasing their bundle break strength. The ratio of bundle break strength ($s_{bb}$) to the ratio of weight to unit area ($r_{w/a}$) is informative in this regard, with a high value of $s_{bb/rw/a}$ being desirable. TABLE 2 displays the bundle break strength ($s_{bb}$), the ratio of weight to unit area ($r_{w/a}$), and the ratio of these two ratios ($s_{bb}/r_{w/a}$).

TABLE 2

Bundle strength, weight/area, and the ratio of these two values for various fastener constructions.

| Example | Sample | Bundle Break Strength (N/m) | Weight/ Area ($g/cm^2$) | Bundle Break Strength/ [Weight/Area] $(km/s)^2$ |
|---|---|---|---|---|
| 21 | CS1200T/45g | 30,000 | 0.0193 | 0.155 |
| 22 | CS1200T450R | 33,700 | 0.0267 | 0.126 |
| 23 | CS1200T/EBL | 25,000 | 0.0222 | 0.112 |
| 24 | CS1200T525S | 29,200 | 0.0272 | 0.107 |
| 25 | CS1200T450S | 23,800 | 0.0248 | 0.096 |
| 26 | PEH 5:1 | 22,300 | 0.0237 | 0.094 |
| 27 | CS1200T525R | 25,100 | 0.0271 | 0.093 |
| 28 | CS600-898 | 42,000 | 0.0455 | 0.092 |
| 29 | CS600-880* | 42,700 | 0.0479 | 0.089 |
| 30 | CS600-8970‡ | 46,600 | 0.0530 | 0.088 |
| 31 | CS600-355* | 31,700 | 0.0464 | 0.068 |
| 32 | PEH 3:1 | 18,600 | 0.0275 | 0.068 |
| 33 | CS600 4:1 | 15,700 | 0.0241 | 0.065 |
| 34 | Nestegard | 21,000 | 0.0324 | 0.065 |
| 35 | HDPE PEH | 21,700 | 0.0357 | 0.061 |
| 36 | CS600 2.5:1 | 15,600 | 0.0259 | 0.060 |
| C8 | Aplix*† | 38,500 | 0.0671 | 0.057 |
| 37 | CS600 3:1 | 13,700 | 0.0266 | 0.052 |
| 38 | CS600-864 | 13,900 | 0.0350 | 0.040 |
| C9 | Velcro* | 22,300 | 0.0684 | 0.033 |
| C10 | Belkin* | 19,300 | 0.0604 | 0.032 |
| C11 | CS500 | 13,900 | 0.0477 | 0.029 |
| 39 | CS600 NoDraw | 9,700 | 0.0363 | 0.027 |
| 40 | ABS PEH | 8,800 | 0.0432 | 0.020 |
| C12 | SCOTCHMATE | 23,700 | 0.1292 | 0.018 |
| C13 | CS600 Tape53 | 5,040 | 0.0278 | 0.018 |
| C14 | CS600 Tape48 | 4,480 | 0.0254 | 0.018 |

Unless otherwise noted, all samples had backing tear failure;
*samples had hook-to-loop shear failure;
‡Sample tested had adhesive to reinforcing layer failure in bundle test;
†sample believed to be Aplix.
Belkin sample had hooks on only approximately 33 mm length of one side;
weight/area shown for this sample is section with hooks and loops.

As seen from the results set forth in TABLE 2, the fasteners of the present invention provide a substantial improvement in bundle break strength per unit of weight/area as compared to known fasteners. Thus, most of the examples tested had a $s_{bb}/r_{w/a}$ ratio of greater than 0.057 $(km/s)^2$, the value observed in EXAMPLE C8. Hence, the fasteners of the present invention provide higher bundle break strengths at a given weight/area than conventional fasteners. EXAMPLES 21–23 are particularly impressive, with values of $s_{bb}/r_{w/a}$ that are about twice that of the conventional fasteners tested.

These examples also illustrate the effect of stretching on the value of $s_{bb}/r_{w/a}$. In particular, the undrawn sample of CS600 has an $s_{bb}/r_{w/a}$ value of only 0.027 $(km/s)^2$, which is lower than the values observed with the commercially available samples of C8 and C9. This value increases with draw ratio so that, after being drawn to a ratio of 2.5:1 (EXAMPLE 36), the value of $s_{bb}r_{w/a}$ exceeds that of EXAMPLE C8 (the value of this parameter may not increase with increasing draw ratio until the material has been stretched to at least its natural draw ratio; hence, EXAMPLE 37 actually has a lower bundle break strength than EXAMPLE 36, even though EXAMPLE 37 is stretched to a higher stretch ratio). When the sample is drawn to a stretch ratio of 4:1 (EXAMPLE 33), the $s_{bb}/r_{w/a}$ value of the sample exceeds that of EXAMPLE C8.

EXAMPLES 41–60 and COMPARATIVE EXAMPLES C15–C21

These examples illustrate the improvements in bundle break strength as a function of thickness attainable with the fasteners of the present invention.

As noted previously, it has been found to be desirable to minimize the fastener thickness while at the same time increasing their bundle break strength. The ratio of bundle break strength ($s_{bb}$) to the fastener thickness (t) is informative in this regard, with a high value of $s_{bb}/t$ being desirable. TABLE 3 displays the bundle break strength ($s_{bb}$), the fastener thickness (t), and the ratio of these two values. Thickness measurements were made with a model 89-100 thickness tester, commercially available from the Thwing Albert Instrument Company, Philadelphia, Pa., for all samples except the SCOTCHMATE sample (the SCOTCHMATE sample was too thick to be determined with the Thwing Albert instrument, and had to be determined instead with a set of vernier calipers). Samples were measured hooks up, with a flat circular testing probe head 15.9 mm in diameter. The probe is applied with sufficient force to compress the loop material of the fastener, but is not applied with enough force to significantly compress the hooks material. Hence, the resulting measurement is the thickness of the fastener from the tips of the hooks to the tips of compressed loop.

TABLE 3

Bundle strength, fastener thickness, and the ratio of these two values for various fastener constructions.

| Example | Sample | Bundle Break Strength (N/m) | Thickness (mm) | Bundle Break Strength/ Thickness ($MN/m^2$) |
|---|---|---|---|---|
| 41 | CS600-898 | 42,000 | 0.89 | 47 |
| 42 | CS600-8970‡ | 46,600 | 1.01 | 46 |
| 43 | CS600-880* | 42,700 | 0.99 | 43 |
| 44 | CS1200T/45g | 30,000 | 0.81 | 37 |
| 45 | CS600-355* | 31,700 | 0.89 | 36 |
| 46 | CS1200T450R | 33,700 | 0.95 | 35 |
| 47 | CS1200T/EBL | 25,000 | 0.79 | 32 |
| 48 | CS1200T525S | 29,200 | 1.04 | 28 |
| C15 | Aplix*† | 38,500 | 1.40 | 28 |
| 49 | CS1200T450S | 23,800 | 0.95 | 25 |
| 50 | CS1200T525R | 25,100 | 1.00 | 25 |
| 51 | PEH 5:1 | 22,300 | 1.04 | 21 |
| 52 | HDPE PEH | 21,700 | 1.07 | 20 |
| 53 | CS600 4:1 | 15,700 | 0.80 | 20 |
| 54 | PEH 3:1 | 18,600 | 1.04 | 18 |
| 55 | CS600 2.5:1 | 15,600 | 0.93 | 17 |
| 56 | CS600 3:1 | 13,700 | 0.85 | 16 |
| 57 | CS600-864 | 13,900 | 0.89 | 16 |
| C16 | Velcro* | 22,300 | 1.47 | 15 |
| 58 | Nestegard | 21,000 | 1.41 | 15 |
| 59 | CS600 NoDraw | 9,700 | 1.00 | 9.7 |
| C17 | CS500 | 13,900 | 1.80 | 7.7 |
| 60 | ABS PEH | 8,760 | 1.22 | 7.2 |
| C18 | SCOTCHMATE | 23,700 | 3.43 | 6.9 |
| C19 | CS600 Tape53 | 5,040 | 0.85 | 6.0 |
| C20 | CS600 Tape48 | 4,480 | 0.81 | 5.5 |
| C21 | Belkin* | 19,300 | 6.32 | 3.1 |

Unless otherwise noted, all samples had backing tear failure;
*samples had hook-to-loop shear failure;
‡Sample tested had adhesive to reinforcing layer failure in bundle test;
†sample believed to be Aplix.
Belkin sample had hooks on only approximately 33 mm length of one side;
thickness shown for this sample is section with hooks and loops.

As seen from these results, the fasteners of the present invention provide a substantial improvement in $s_{bb}/t$ as compared to conventional fasteners. Thus, of the comparative examples, EXAMPLE C15 had the highest value of $s_{bb}/t$ (28 $MN/m^2$), while many of the examples of the invention had values for $s_{bb}/t$ which were higher than 28. EXAMPLES 41–46 were particularly impressive.

TABLE 3 also illustrates the improvement in thickness of the films achieved with the fasteners of the present invention. In particular, the Aplix sample (EXAMPLE C15) had the least thickness of the commercial fasteners (1.40 mm), while all of the fasteners of the present invention were substantially thinner.

TABLE 3 further illustrates the improvement in bundle break strength ($s_{bb}$) possible with the fasteners of the present invention. In particular, EXAMPLES 41–43 all exhibited $s_{bb}$ values which were substantially higher than those exhibited by the comparative examples.

EXAMPLES 61–80 and COMPARATIVE EXAMPLES C22–C27

These examples illustrate the improvements in tensile strength per unit of stiffness that are achievable with the fasteners of the present invention.

An alternative mode of testing UL-1565 bundle strength is to wrap the fastener around a split mandrel or split cylinder. The half-cylinders are then pulled apart, in a direction normal to the split, in the manner described for the previous test. Pulled to fastener breakage, the failure mode would be tensile failure of the fastener, since there is no tearing force concentrated by the single wire of the previously described test. Because of the geometry of this test, the load at failure would be approximately twice the tensile strength. Approximations of this test have been run in the form of tensile and elongation measurements.

TABLE 4 displays the tensile strength ($s_t$) for the 12.7 mm wide specimens, measured from tensile and elongation experiments. Fastener specimens were 12.7 mm (½") wide with a 102 mm (4") gauge length, and were pulled at a rate of 508 mm/min (20 inches/min). A new parameter, the ratio of tensile strength for each 12.7 mm specimen to its stiffness (this ratio is denoted herein as $r_{st/s}$), is also shown in Table 4.

TABLE 4

Tensile strength, stiffness and the corresponding ratio of tensile strength to stiffness for various 12.7 mm wide hook and loop fastener constructions.

| Example | Sample | Normalized Tensile Strength (N/m) | Stiffness (N/m) | Tensile Strength/ Stiffness |
|---|---|---|---|---|
| 61 | CS600-898 | 61,600 | 33 | 1,867 |
| 62 | CS600-8970 | 67,200 | 45 | 1,510 |
| 63 | CS1200T/45g | 18,600 | 13 | 1,431 |
| 64 | CS600-355 | 41,300 | 32 | 1,287 |
| 65 | CS600-864 | 33,900 | 28 | 1,211 |
| 66 | PEH 5:1 | 20,500 | 17 | 1,199 |
| 67 | CS600-880 | 51,000 | 50 | 1,014 |
| 68 | CS1200T/EBL | 15,700 | 19 | 826 |
| 69 | CS600 4:1 | 11,100 | 17 | 638 |
| 70 | CS1200T450S | 20,200 | 34 | 601 |
| 71 | CS1200T450R | 16,900 | 34 | 491 |
| 72 | CS1200T525R | 15,000 | 33 | 460 |
| 73 | PEH 3:1 | 13,100 | 29 | 458 |
| 74 | CS600 3:1 | 8,230 | 19 | 424 |
| 75 | CS600 2.5:1 | 8,270 | 21 | 400 |
| C22 | Aplix | 38,700 | 99 | 392 |
| 76 | CS1200T525S | 14,000 | 36 | 390 |
| 77 | Nestegard | 12,400 | 41 | 300 |
| C23 | CS600 Tape48 | 2,660 | 9 | 283 |
| 78 | HDPE PEH | 10,900 | 48 | 228 |
| C24 | CS600 Tape53 | 3,150 | 19 | 168 |
| C25 | Velcro | 18,800 | 118 | 159 |
| C26 | SCOTCHMATE | 51,500 | 325 | 158 |
| 79 | ABS PEH | 11,200 | 109 | 102 |

TABLE 4-continued

Tensile strength, stiffness and the corresponding ratio of tensile strength to stiffness for various 12.7 mm wide hook and loop fastener constructions.

| Example | Sample | Normalized Tensile Strength (N/m) | Stiffness (N/m) | Tensile Strength/ Stiffness |
|---|---|---|---|---|
| 80 | CS600 NoDraw | 7,110 | 72 | 99 |
| C27 | CS500 | 9,740 | 157 | 62 |

Belkin sample not displayed;
hooks covered approximately 33 mm of one side, so hook and loop construction could not be tested in accordance with other samples.

The commercially available bundling straps from Aplix and Velcro (EXAMPLES C22 and C25, respectively), along with the constructions containing no strength enhancement (CS500 and Scotchmate, EXAMPLES C27 and C26, respectively), have relatively low $r_{st/s}$ values. The constructions with strength enhancement generally have high $r_{st/s}$ values. The CS600 Tape samples with no strength enhancement have a very low tensile strength. These examples indicate a clear delineation in the values of $r_{st/s}$ for the constructions of the present invention as compared to the conventional fasteners tested, and show the increased strength and flexibility exhibited by the fasteners of the present invention. EXAMPLES 61–62 are particularly impressive in that they exhibit a substantially higher tensile strength and lower stiffness (and therefore a much higher $r_{st/s}$ value) than any of the conventional samples of the comparative examples.

EXAMPLES 81–100 and COMPARATIVE EXAMPLES C28–C33

These examples illustrate the improvement in tensile strength per weight area achievable with the fasteners of the present invention.

As noted previously, it has been found to be desirable to maximize both the strength and the flexibility of the fasteners. The ratio of tensile strength ($s_t$) to the ratio of weight/unit area ($r_{w/a}$) is informative in this regard, with a high value of $s_t/r_{w/a}$ being desirable (this ratio is denoted as $r_{st/rwa}$). These values are set forth in TABLE 5.

TABLE 5

Tensile strength and weight/area for various hook and loop fastener constructions, and the corresponding ratio of tensile strength to weight/area.

| Example | Sample | Normalized Tensile Strength (N/m) | Weight/ Area ($g/cm^2$) | Tensile Strength/ [Weight/Area] $(km/s)^2$ |
|---|---|---|---|---|
| 81 | CS600-898 | 61,600 | 0.0455 | 0.135 |
| 82 | CS600-8970 | 67,200 | 0.0530 | 0.127 |
| 83 | CS600-880 | 51,000 | 0.0479 | 0.106 |
| 84 | CS600-864 | 33,900 | 0.0350 | 0.097 |
| 85 | CS1200T/45g | 18,600 | 0.0193 | 0.096 |
| 86 | CS600-355 | 41,300 | 0.0464 | 0.089 |
| 87 | PEH 5:1 | 20,500 | 0.0237 | 0.086 |
| 88 | CS1200T450S | 20,200 | 0.0248 | 0.081 |
| 89 | CS1200T/EBL | 15,700 | 0.0222 | 0.071 |
| 90 | CS1200T450R | 16,900 | 0.0267 | 0.063 |
| C28 | Aplix | 38,700 | 0.0671 | 0.058 |
| 91 | CS1200T525R | 15,000 | 0.0271 | 0.055 |
| 92 | CS1200T525S | 14,000 | 0.0272 | 0.051 |
| 93 | PEH 3:1 | 13,100 | 0.0275 | 0.048 |
| 94 | CS600 4:1 | 11,100 | 0.0241 | 0.046 |

TABLE 5-continued

Tensile strength and weight/area for various hook and loop fastener constructions, and the corresponding ratio of tensile strength to weight/area.

| Example | Sample | Normalized Tensile Strength (N/m) | Weight/ Area ($g/cm^2$) | Tensile Strength/ [Weight/Area] $(km/s)^2$ |
|---|---|---|---|---|
| C29 | SCOTCHMATE | 51,500 | 0.1292 | 0.040 |
| 95 | Nestegard | 12,400 | 0.0324 | 0.038 |
| 96 | CS600 2.5:1 | 8,270 | 0.0259 | 0.032 |
| 97 | CS600 3:1 | 8,230 | 0.0266 | 0.031 |
| 98 | HDPE PEH | 10,900 | 0.0357 | 0.031 |
| C30 | Velcro | 18,800 | 0.0684 | 0.027 |
| 99 | ABS PEH | 11,200 | 0.0432 | 0.026 |
| C31 | CS500 | 9,740 | 0.0477 | 0.020 |
| 100 | CS600 NoDraw | 7,110 | 0.0363 | 0.020 |
| C32 | CS600 Tape53 | 3,150 | 0.0278 | 0.011 |
| C33 | CS600 Tape48 | 2,660 | 0.0254 | 0.010 |

Belkin sample not displayed;
hooks covered approximately 33 mm of one side, so hook and loop construction could not be tested in accordance with other samples.

As seen from the results in TABLE 5, most of the fasteners of the present invention are capable of providing improved tensile strength at comparable or lower weight/area than the conventional fasteners tested. The samples of EXAMPLES 81–82 were particularly impressive, with $s_t/r_{w/a}$ ratios more than twice those of the conventional fasteners tested, thus reflecting the fact that these samples were substantially stronger and lighter than the conventional fasteners tested.

EXAMPLES 101–120 and COMPARATIVE EXAMPLES C34–C39

It has also been found to be desirable to maximize both the tensile strength while minimizing fastener thickness. The ratio of tensile strength ($s_t$) to the fastener thickness (t) is informative in this regard, with a high value of $s_t/t$ being desirable (this ratio is denoted as $r_{st/t}$). These values are set forth in TABLE 6 for a variety of samples. As seen from the results, the fasteners of the present invention provide improved tensile strength at comparable or lower thicknesses than the conventional fasteners tested.

TABLE 6

Tensile strength and thickness for various hook and loop fastener constructions, and the corresponding ratio of tensile strength to thickness.

| Example | Sample | Normalized Tensile Strength (N/m) | Thickness (mm) | Tensile Strength/ Thickness ($MN/m^2$) |
|---|---|---|---|---|
| 101 | CS600-898 | 61,600 | 0.89 | 69 |
| 102 | CS600-8970 | 67,200 | 1.01 | 66 |
| 103 | CS600-880 | 51,000 | 0.99 | 52 |
| 104 | CS600-355 | 41,300 | 0.89 | 46 |
| 105 | CS600-864 | 33,900 | 0.89 | 38 |
| C34 | Aplix | 38,700 | 1.40 | 28 |
| 106 | CS1200T/45g | 18,600 | 0.81 | 23 |
| 107 | CS1200T450S | 20,200 | 0.95 | 21 |
| 108 | CS1200T/EBL | 15,700 | 0.79 | 20 |
| 109 | PEH 5:1 | 20,500 | 1.04 | 20 |
| 110 | CS1200T450R | 16,900 | 0.95 | 18 |
| C35 | SCOTCHMATE | 51,500 | 3.43 | 15 |
| 111 | CS1200T525R | 15,000 | 1.00 | 15 |
| 112 | CS600 4:1 | 11,100 | 0.80 | 14 |
| 113 | CS1200T525S | 14,000 | 1.04 | 13 |
| C36 | Velcro | 18,800 | 1.47 | 13 |

TABLE 6-continued

Tensile strength and thickness for various hook and loop fastener constructions, and the corresponding ratio of tensile strength to thickness.

| Example | Sample | Normalized Tensile Strength (N/m) | Thickness (mm) | Tensile Strength/ Thickness ($MN/m^2$) |
|---|---|---|---|---|
| 114 | PEH 3:1 | 13,100 | 1.04 | 13 |
| 115 | HDPE PEH | 10,900 | 1.07 | 10.2 |
| 116 | CS600 3:1 | 8,230 | 0.85 | 9.7 |
| 117 | ABS PEH | 11,200 | 1.22 | 9.2 |
| 118 | CS600 2.5:1 | 8,270 | 0.93 | 8.9 |
| 119 | Nestegard | 12,400 | 1.41 | 8.8 |
| 120 | CS600 NoDraw | 7,110 | 1.00 | 7.1 |
| C37 | CS500 | 9,740 | 1.80 | 5.4 |
| C38 | CS600 Tape53 | 3,150 | 0.85 | 3.7 |
| C39 | CS600 Tape48 | 2,660 | 0.81 | 3.3 |

Belkin sample not displayed;
hooks covered approximately 33 mm of one side, so hook and loop construction could not be tested in accordance with other samples.

As seen from the results in TABLE 6, fasteners of the present invention are capable of providing improved tensile strength while minimizing thickness as compared to the conventional fasteners tested. The samples of EXAMPLES 101 and 102 were particularly impressive, with $s_t/t$ ratios more than twice those of the conventional fasteners tested, thus reflecting the fact that these samples were substantially stronger and thinner than the conventional fasteners tested.

EXAMPLES 121–140 and COMPARATIVE EXAMPLES C40–C45

These examples illustrate the improvements in tensile modulus, stiffness, and tensile modulus per unit of stiffness that are achievable with the fasteners of the present invention.

The aforementioned UL-1565 1/16" (1.59 mm) slippage clause may be assessed in terms of tensile modulus. For moderate loads, a high modulus construction will stretch less than a fastener with a low modulus, thus maintaining a better grip around a bundle. As before, it is also desired to maintain good flexibility of the fastener. The tensile modulus was determined for the various fastener samples with 12.7 mm (½ in) wide samples, a gauge length of 102 mm (4 in), and a crosshead speed of 508 mm/min (20 in/min). Modulus values were normalized to fastener width. TABLE 7 gives these normalized tensile modulus data along with a new figure of merit, the tensile modulus divided by the stiffness.

TABLE 7

Tensile modulus for various hook and loop fastener constructions, and the corresponding ratio of tensile modulus to stiffness.

| Example | Sample | Normalized Tensile Modulus (MN/m) | Stiffness (N/m) | Normalized Tensile Modulus/ Stiffness |
|---|---|---|---|---|
| 121 | CS600-898 | 1.38 | 33 | 41,795 |
| 122 | CS600-8970 | 1.68 | 45 | 37,763 |
| 123 | CS1200T/45g | 0.20 | 13 | 15,424 |
| 124 | CS600-880 | 0.73 | 50 | 14,573 |
| 125 | CS600-355 | 0.45 | 32 | 14,026 |
| 126 | CS600-864 | 0.38 | 28 | 13,447 |
| 127 | PEH 5:1 | 0.21 | 17 | 12,084 |
| 128 | CS600 4:1 | 0.21 | 17 | 11,795 |
| 129 | CS1200T/EBL | 0.22 | 19 | 11,484 |
| C40 | CS600 Tape48 | 0.10 | 9 | 10,917 |

TABLE 7-continued

Tensile modulus for various hook and loop fastener constructions, and the corresponding ratio of tensile modulus to stiffness.

| Example | Sample | Normalized Tensile Modulus (MN/m) | Stiffness (N/m) | Normalized Tensile Modulus/ Stiffness |
|---|---|---|---|---|
| 130 | CS600 3:1 | 0.20 | 19 | 10,281 |
| 131 | CS600 2.5:1 | 0.18 | 21 | 8,502 |
| C41 | CS600 Tape53 | 0.13 | 19 | 6,771 |
| 132 | CS1200T450S | 0.22 | 34 | 6,640 |
| 133 | CS1200T525R | 0.20 | 33 | 6,027 |
| 134 | CS1200T450R | 0.21 | 34 | 6,022 |
| 135 | PEH 3:1 | 0.16 | 29 | 5,498 |
| 136 | CS1200T525S | 0.19 | 36 | 5,332 |
| 137 | HDPE PEH | 0.25 | 48 | 5,301 |
| 138 | Nestegard | 0.22 | 41 | 5,249 |
| 139 | ABS PEH | 0.43 | 109 | 3,893 |
| 140 | CS600 NoDraw | 0.28 | 72 | 3,882 |
| C42 | CS500 | 0.37 | 157 | 2,350 |
| C43 | Aplix | 0.16 | 92 | 1,694 |
| C44 | Velcro | 0.15 | 118 | 1,235 |
| C45 | SCOTCHMATE | 0.31 | 325 | 955 |

Belkin sample not displayed;
hooks covered approximately 33 mm of one side, so hook and loop construction could not be tested in accordance with other samples.

Again, the commercially available bundling straps from Aplix and Velcro, along with the constructions containing no strength enhancement (CS500 and Scotchmate), have relatively low tensile modulus/stiffness. The constructions with strength enhancement generally have high tensile modulus/stiffness values. The CS600 Tape samples again displays the weakest tensile modulus value.

The results set forth in TABLE 7 also show that fasteners can be made in accordance with the present invention which have higher tensile moduli and lower flex moduli than conventional fasteners. Thus, EXAMPLE C42 exhibited the highest tensile modulus (0.37 MN/m) for the conventional fasteners, but EXAMPLES 121, 122, 124, and 125 had tensile moduli that were substantially higher. EXAMPLES 121 and 122 were particularly impressive, with tensile moduli several times that of EXAMPLE C42.

EXAMPLES 141–160 and COMPARATIVE EXAMPLES C46–C51

These examples illustrate the improvements in tensile modulus per weight area achievable with the fasteners of the present invention.

For certain applications such as aerospace, a high strength, lightweight fastener is desirable. TABLE 8 exhibits the relative weights of each of the constructions, and further gives a new figure of merit, the tensile modulus ($m_t$) divided by the relative weight/area ($r_{w/a}$), or $m_t/r_{w/a}$.

TABLE 8

Tensile modulus, weight/area, and the ratio of these two values for various hook and loop fastener constructions.

| Example | Sample | Normalized Tensile Modulus (MN/m) | Weight/ Area (g/cm$^2$) | Tensile Modulus/ [Weight/Area] (km/s)$^2$ |
|---|---|---|---|---|
| 141 | CS600-8970 | 1.68 | 0.0530 | 3.17 |
| 142 | CS600-898 | 1.38 | 0.0455 | 3.03 |
| 143 | CS600-880 | 0.73 | 0.0479 | 1.53 |

TABLE 8-continued

Tensile modulus, weight/area, and the ratio of these two values for various hook and loop fastener constructions.

| Example | Sample | Normalized Tensile Modulus (MN/m) | Weight/ Area (g/cm$^2$) | Tensile Modulus/ [Weight/Area] (km/s)$^2$ |
|---|---|---|---|---|
| 144 | CS600-864 | 0.38 | 0.0350 | 1.08 |
| 145 | CS1200T/45g | 0.20 | 0.0193 | 1.04 |
| 146 | ABS PEH | 0.43 | 0.0432 | 0.99 |
| 147 | CS1200T/EBL | 0.22 | 0.0222 | 0.98 |
| 148 | CS600-355 | 0.45 | 0.0464 | 0.97 |
| 149 | CS1200T450S | 0.22 | 0.0248 | 0.90 |
| 150 | PEH 5:1 | 0.21 | 0.0237 | 0.87 |
| 151 | CS600 4:1 | 0.21 | 0.0241 | 0.85 |
| 152 | CS1200T450R | 0.21 | 0.0267 | 0.78 |
| C46 | CS500 | 0.37 | 0.0477 | 0.77 |
| 153 | CS600 NoDraw | 0.28 | 0.0363 | 0.77 |
| 154 | CS600 3:1 | 0.20 | 0.0266 | 0.75 |
| 155 | CS1200T525R | 0.20 | 0.0271 | 0.73 |
| 156 | HDPE PEH | 0.25 | 0.0357 | 0.71 |
| 157 | CS1200T525S | 0.19 | 0.0272 | 0.70 |
| 158 | CS600 2.5:1 | 0.18 | 0.0259 | 0.68 |
| 159 | Nestegard | 0.22 | 0.0324 | 0.67 |
| 160 | PEH 3:1 | 0.16 | 0.0275 | 0.57 |
| C47 | CS600 Tape53 | 0.13 | 0.0278 | 0.46 |
| C48 | CS600 Tape48 | 0.10 | 0.0254 | 0.40 |
| C49 | SCOTCHMATE | 0.31 | 0.1292 | 0.24 |
| C50 | Aplix | 0.16 | 0.0671 | 0.23 |
| C51 | Velcro | 0.15 | 0.0684 | 0.21 |

Belkin sample not displayed;
hooks covered approximately 33 mm of one side, so hook and loop construction could not be tested in accordance with other samples.

As shown by the results in TABLE 8, the fastener constructions of the present invention provide a significantly higher $m_t/r_{w/a}$ values than the conventional fasteners tested. Thus, the highest value for this parameter observed with the conventional fasteners tested was 0.77 (km/s)$^2$ (EXAMPLE C46). By contrast, most of the samples of the present invention had $m_t/r_{w/a}$ values of 0.78 (km/s)$^2$ or higher. EXAMPLES 141–145 were particularly impressive. Hence, EXAMPLE 143 had a $m_t/r_{w/a}$ value that was about twice that observed with EXAMPLE C46, while EXAMPLES 141–142 had $m_t/r_{w/a}$ values about four times that of EXAMPLE C46. This demonstrates that fasteners can be made in accordance with the present invention which have higher tensile moduli per weight than those observed with conventional fasteners.

EXAMPLES 161–180 and COMPARATIVE EXAMPLES C52–C57

These examples illustrate the improvement in tensile modulus per unit thickness obtained with the fasteners of the present invention.

The normalized tensile modulus, thickness, and tensile modulus per unit thickness ($m_t/t$) are set forth in TABLE 9.

TABLE 9

Tensile modulus, thickness, and the ratio of these values for various hook and loop fastener constructions.

| Example | Sample | Normalized Tensile Modulus (MN/m) | Thickness (mm) | Tensile Modulus/ Thickness (GN/m$^2$) |
|---|---|---|---|---|
| 161 | CS600-8970 | 1.68 | 1.01 | 1.66 |
| 162 | CS600-898 | 1.38 | 0.89 | 1.55 |

TABLE 9-continued

Tensile modulus, thickness, and the ratio of these values for various hook and loop fastener constructions.

| Example | Sample | Normalized Tensile Modulus (MN/m) | Thickness (mm) | Tensile Modulus/ Thickness ($GN/m^2$) |
|---|---|---|---|---|
| 163 | CS600-880 | 0.73 | 0.99 | 0.74 |
| 164 | CS600-355 | 0.45 | 0.89 | 0.51 |
| 165 | CS600-864 | 0.38 | 0.89 | 0.42 |
| 166 | ABS PEH | 0.43 | 1.22 | 0.35 |
| 167 | CS600 NoDraw | 0.28 | 1.00 | 0.28 |
| 168 | CS1200T/EBL | 0.22 | 0.79 | 0.28 |
| 169 | CS600 4:1 | 0.21 | 0.80 | 0.26 |
| 170 | CS1200T/45g | 0.20 | 0.81 | 0.25 |
| 171 | HDPE PEH | 0.25 | 1.07 | 0.24 |
| 172 | CS1200T450S | 0.22 | 0.95 | 0.24 |
| 173 | CS600 3:1 | 0.20 | 0.85 | 0.24 |
| 174 | CS1200T450R | 0.21 | 0.95 | 0.22 |
| C52 | CS500 | 0.37 | 1.80 | 0.20 |
| 175 | PEH 5:1 | 0.21 | 1.04 | 0.20 |
| 176 | CS1200T525R | 0.20 | 1.00 | 0.20 |
| 177 | CS600 2.5:1 | 0.18 | 0.93 | 0.19 |
| 178 | CS1200T525S | 0.19 | 1.04 | 0.18 |
| 179 | Nestegard | 0.22 | 1.41 | 0.15 |
| 180 | PEH 3:1 | 0.16 | 1.04 | 0.15 |
| C53 | CS600 Tape53 | 0.13 | 0.85 | 0.15 |
| C54 | CS600 Tape48 | 0.10 | 0.81 | 0.13 |
| C55 | Aplix | 0.16 | 1.40 | 0.11 |
| C56 | Velcro | 0.15 | 1.47 | 0.10 |
| C57 | SCOTCHMATE | 0.31 | 3.43 | 0.09 |

Belkin sample not displayed;
hooks covered approximately 33 mm of one side, so hook and loop construction could not be tested in accordance with other samples.

The results set forth in TABLE 9 demonstrate the improvement in tensile modulus per unit thickness ($m_t/t$) achievable with the fasteners of the present invention (the improvement in tensile modulus alone is noted with respect to some of the previous examples). In particular, of the conventional fasteners tested, the fastener of EXAMPLE C52 exhibited the highest value for $m_t/t$ (0.20 $GN/m^2$). By contrast, nearly three quarters of the samples made in accordance with the present invention had $m_t/t$ values that were higher than this. EXAMPLES 161–165 were particularly impressive in that they exhibited $m_t/t$ values that were more than twice those of EXAMPLE C52, while EXAMPLES 161–162 had $m_t/t$ values that were more than seven times greater than the corresponding value for EXAMPLE C52.

EXAMPLES 181–187 and COMPARATIVE EXAMPLE C58

These examples illustrate the improvement in flagging seen in fasteners made in accordance with the present invention.

In EXAMPLES 181–187, the flagging characteristics of seven samples made in accordance with the present invention were determined and were compared with the flagging characteristics of a commercially available Velcro sample (EXAMPLE C58).

Figure 5:
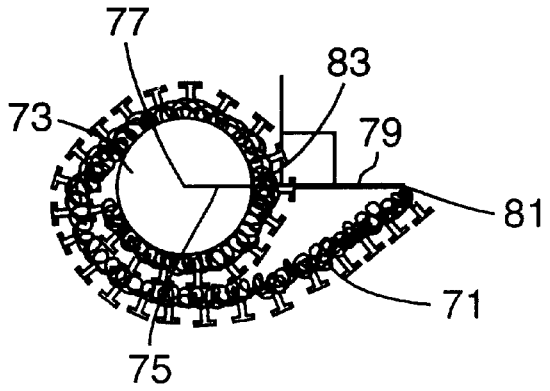
FIG. 5 is a schematic drawing illustrating the measurement of flagging.

The concept of flagging is depicted schematically in FIG. 5. Specimens were evaluated in the flagging test by wrapping a first end of a 12.7 mm width fastener strip 71 around a 3.175 mm diameter cylinder 73, and then rotating the cylinder while a second end of the fastener was attached to a 500 gram weight. The weight was removed and the fastener was trimmed beyond the point where it wrapped the cylinder completely and overlapped on itself for approximately half the circumference of the cylinder. The assembly was inserted into the holes of a heavy base, such that the wraps were upstanding and not disturbed, and then it was allowed to condition at 23±1° C. and 50±2% relative humidity for one day. After conditioning, a microscope was used to measure flagging in a cross sectional view of the cylinder. A line 75 was drawn from the tip of the free-lifted end of the fastener through the center 77 of the cylinder. The flagging distance 79 is defined as the distance along this line from the lifted tip 81 to the outer surface of the fastener base 83.

As previously noted, a low flagging value is desirable, because excessive flagging can lead to fastener failure, and allows dirt and other contaminants to accumulate in the aperture formed by flagging. Excessive flagging also provides a greater surface area of the fastener that can be snagged. The bundle break strength per unit flagging, the tensile strength per unit flagging, and the tensile modulus per unit flagging were also determined for each example.

TABLE 10

Flagging characteristics for various embodiments of the invention.

| Example | Sample | Flagging (mm) | Bundle Break Strength/ Flagging (MN/m2) | Tensile Strength/ Flagging (MN/m2) | Tensile Modulus/ Flagging (MN/m2) |
|---|---|---|---|---|---|
| 181 | CS600-898 | 2.36 | 17.8 | 26.1 | 584 |
| 182 | CS600-880 | 2.09 | 20.4 | 24.4 | 351 |
| 183 | CS600-864 | 1.67 | 8.3 | 20.3 | 225 |
| 184 | PEH 5:1 | 2.14 | 10.4 | 9.6 | 97 |
| 185 | CS1200T/45g | 2.16 | 13.9 | 8.6 | 93 |
| 186 | CS1200T/EBL | 2.38 | 10.5 | 6.6 | 92 |
| 187 | PEH 3:1 | 2.03 | 9.1 | 6.5 | 77 |
| C58 | Velcro* | 3.02 | 7.4 | 6.2 | 48 |

As indicated by the results in TABLE 10, the flagging in each of the samples of the present invention was lower than the flagging observed with the commercially available Velcro® fastener sample. Moreover, the ratio of bundle break strength to flagging was observed to be higher in the samples of the present invention than in the Velcro® fastener sample. A high number for this ratio is desirable, because it indicates that a given level of bundle break strength was achieved without causing excessive flagging.

The ratio of tensile modulus to flagging was observed to be higher in the samples of the present invention than in the Velcro® fastener sample. A high number for this ratio is desirable because it indicates that a given level of tensile modulus was achieved without causing excessive flagging.

The ratio of tensile strength to flagging was observed to be higher in the samples of the present invention than in the Velcro® fastener sample. A high number for this ratio is desirable, because it indicates that a given level of tensile strength was achieved without excessive flagging.

EXAMPLES 188–196

The following examples illustrate the variations in the thickness of individual layers possible in some of the constructions made in accordance with the present invention.

TABLE 11

Thicknesses of various component layers in the hook and loop type fasteners of the invention.

| Example | Sample | Overall Thickness (mm) | Backing Thickness (mm) | PSA Thickness (mm) | Corresponding Sample |
|---|---|---|---|---|---|
| 188 | 3M #355 Box Sealing Tape | 0.086 | 0.055 | 0.031 | CS600-355 |
| 189 | 3M #864 Ribbed Tape | 0.15 | 0.119 | 0.031 | CS600-864 |
| 190 | 3M #898 glass filament tape | 0.15 | 0.115 | 0.035 | CS600-898 |
| 191 | 3M #880 polymer filament tape | 0.22 | 0.185 | 0.035 | CS600-880 |
| 192 | 3M #8970 glass cloth | 0.19 | 0.19 | — | CS600-8970 |
| 193 | acrylate adhesive | 0.030 | — | 0.030 | various |
| 194 | urethane adhesive | 0.004 | — | 0.004 | CS1200T-45g |
| 195 | EBL base | 0.029–0.052 | 0.029–0.052 | | CS1200T-EBL, various |
| 196 | hookbase | 0.050–0.10 | | | all |

The above description of the present invention is merely illustrative, and is not intended to be limiting. Accordingly, the scope of the present invention should be construed in reference to the appended claims.

What is claimed is:

1. A fastener, comprising:

a uniaxially oriented polymeric substrate;

a plurality of hooks disposed on a first side of said substrate; and a plurality of loops disposed on a second side of said substrate;

wherein said fastener has a longitudinal axis, and wherein said substrate is oriented along said longitudinal axis, wherein a) said fastener has a ratio $r_{w/a}$ defined by the equation $r_{w/a}$=weight/area, wherein said fastener has a bundle break $s_{bb}$, and wherein the ratio $s_{bb}/r_{w/s}$ is greater than 0.09 $(km/s)^2$, b) said fastener has a ratio $r_{w/a}$ defined by the equation $r_{w/a}$=weight/area, wherein said fastener has a normalized tensile modulus of $m_t$, and wherein the ratio $m_t/r_{w/a}$ is greater than 0.85 $(km/s)^2$, c) said fastener has a stiffness s, and wherein the ratio $s_{bb}/s$ is greater than 770, d) said fastener has a tensile strength $s_t$, and wherein the ratio $r_{st/s}=s_t/s$ is greater than 600, and e) wherein the ratio $r_{mt/s}=m_t/s$ is greater than 11,000.

2. The fastener of claim 1, wherein a ratio r ($_{mt/t}=m_t/t$) is greater than 0.28 $GN/m^{2'}$, and where said fastener has a thickness t, and wherein the ratio r ($s_{bb}/t$) is greater than 35 $MN/m^{2'}$ and wherein a ratio r($s_t/r_{w/a}$) is greater than 0.07 $(km/s)^{2'}$.

3. The fastener of claim 1, wherein $s_{bb}/r_{w/a}$ is greater than about 0.1 $(km/s)^2$.

4. The fastener of claim 1, wherein $s_{bb}/r_{w/a}$ is greater than about 0.15 $(km/s)^2$.

5. The fastener of claim 1, wherein $s_{bb}$ is at least about 15,700 N/m.

6. The fastener of claim 1, wherein $s_{bb}$ is at least about 22,300 N/m.

7. The fastener of claim 1, wherein $s_{bb}$ is at least 30,000 N/m.

8. The fastener of claim 1, wherein $r_{w/a}$ is less than about 0.055 $g/cm^2$.

9. The fastener of claim 1, wherein $r_{w/a}$ is less than about 0.03 $g/cm^2$.

10. The fastener of claim 1, wherein $r_{w/a}$ is less than about 0.02 $g/cm^2$.

11. The fastener of claim 1, wherein $m_t$ is at least about 0.2 MN/m.

12. The fastener of claim 1, wherein $m_t$ is greater than 0.8 MN/m.

13. The fastener of claim 1, wherein $s_t$ is at least 11,000 N/m.

14. The fastener of claim 1, wherein $s_t$ is greater than about 60,000 N/m.

15. The fastener of claim 1, wherein the ratio $s_{bb}$ is at least about 950.

16. The fastener of claim 1, wherein the ratio $s_{bb}/s$ is at least about 1500.

17. The fastener of claim 1, wherein s is less than about 51 N/m.

18. The fastener of claim 1, wherein s is less than about 46 N/m.

19. The fastener of claim 1, wherein s is less than about 15 N/m.

20. The fastener of claim 1, wherein $r_{st/s}$ is at least about 1500.

21. The fastener of claim 1, wherein the ratio $r_{mt/s}$ is at least about 37,000.

22. The fastener of claim 1, wherein $r_{mt/t}=m_t t$ is greater than about 1.5 $GN/m^2$.

23. The fastener of claim 1, wherein r($_{sbb/t}$) is at least about 40 $MN/mr^2$.

24. The fastener of claim 1, wherein said plurality of hooks includes a plurality of profile extruded hooks.

25. The fastener of claim 1, further comprising an adhesive disposed on a second surface of said substrate.

26. The fastener of claim 1, wherein said fastener is oriented along its longitudinal axis to a stretch ratio of at least 3:1.

27. The fastener of claim 1, wherein said fastener is oriented along its longitudinal axis to a stretch ratio of at least 4:1.

28. The fastener of claim 1, wherein said fastener is oriented along its longitudinal axis to a stretch ratio of at least 5:1.

29. The fastener of claim 1, wherein said plurality of hooks are disposed in a surface layer disposed on said substrate, and wherein said surface layer is unoriented.

30. The fastener of claim 1, wherein said fastener has at least one layer disposed between said substrate and said plurality of hooks.

31. The fastener of claim 1, wherein said fastener has at least one layer disposed between said substrate and said plurality of loops.

32. The fastener of claim 1, wherein said fastener has a thickness of less than 1.4 mm.

33. The fastener of claim 1, wherein said fastener has a thickness of less than about 1.1 mm.

34. The fastener of claim 1, wherein said substrate comprises a polyolefin.

35. The fastener of claim 34, wherein in said polyolefin is polypropylene.

36. The fastener of claim 1, in combination with a plurality of objects having a longitudinal axis, said objects being assembled into a bundle, and said fastener being disposed about the periphery of said bundle.

37. The fastener of claim 36, wherein said bundle comprises a plurality of optical fibers.

* * * * *

UNITED STATES PATENT AND TRADEMARK OFFICE

CERTIFICATE OF CORRECTION

PATENT NO. : 6,484,371 B1
DATED : November 26, 2002
INVENTOR(S) : Romanko, Walter R.

It is certified that error appears in the above-identified patent and that said Letters Patent is hereby corrected as shown below:

Column 5,
Line 23, at the beginning of the line, "$r_{sbb,f}=s_{bb}/f$" should read -- $r_{sbb/f}=s_{bb}/f$ --.
Line 30, "tensile strength st" should read -- tensile strength $s_t$ --.
Line 40, at the beginning of the line, "(km/s2," should read -- $(km/s)^2$ --.
Line 59, at the beginning of the line, "about 20 MN/m," should read -- about 20 $MN/m^2$ --.

Column 8,
Line 61, at the end of the line, "IR beater" should read -- IR heater --.

Column 19,
Line 35, at the end of the line, "for $r_{sbb/}s$," should read -- for $r_{sbb/s}$ --.

Column 20,
Line 64, at the end of the line, "$s_{bb/rw/a}$" should read -- $s_{bb}/r_{w/a}$ --.

Column 30,
Line 58, "excessive flagging" should read -- causing excessive flagging. --.

Column 32,
Line 28, "wherein $r_{mt/t}=m_t t$ is greater" should read -- wherein $r_{mt/t}=m_t/t$ is greater --.

Signed and Sealed this

Twenty-fifth Day of March, 2003

JAMES E. ROGAN
*Director of the United States Patent and Trademark Office*